US008550733B2

(12) United States Patent
Mori et al.

(10) Patent No.: US 8,550,733 B2
(45) Date of Patent: Oct. 8, 2013

(54) PRINTING APPARATUS WITH SEALED GEAR DRIVE MECHANISM

(75) Inventors: Yukihiro Mori, Shinagawa (JP); Sumio Watanabe, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 942 days.

(21) Appl. No.: 12/068,127

(22) Filed: Feb. 1, 2008

(65) Prior Publication Data

US 2009/0074496 A1 Mar. 19, 2009

(30) Foreign Application Priority Data

Sep. 19, 2007 (JP) ..... 2007-242798
Sep. 19, 2007 (JP) ..... 2007-242799

(51) Int. Cl.
*B41J 11/04* (2006.01)
*B41J 11/70* (2006.01)
*B41J 29/02* (2006.01)

(52) U.S. Cl.
USPC ..... 400/569; 400/691; 400/693

(58) Field of Classification Search
USPC ..... 400/569, 636.2, 621, 691, 693; 310/99
See application file for complete search history.

(56) References Cited

U.S. PATENT DOCUMENTS 2,950,635 A * 8/1960 Bieger et al. ..... 475/338
5,496,120 A * 3/1996 Kakuguchi ..... 400/569
5,746,527 A 5/1998 Nebashi et al.
6,031,308 A * 2/2000 Kinoshita et al. ..... 310/83
6,975,340 B2 * 12/2005 Hoshino et al. ..... 347/197
2001/0010439 A1 * 8/2001 Klingler et al. ..... 310/99
2003/0059241 A1 * 3/2003 Yehl et al. ..... 400/120.01
2005/0036820 A1 2/2005 Watanabe et al.
2005/0276645 A1 * 12/2005 Hirte et al. ..... 400/59
2006/0176360 A1 * 8/2006 Montagutelli ..... 347/222
2006/0291933 A1 * 12/2006 Watanabe et al. ..... 400/58
2008/0019757 A1 * 1/2008 Watanabe ..... 400/648
2011/0044746 A1 * 2/2011 Nagata ..... 400/583

FOREIGN PATENT DOCUMENTS

CN 2825291 Y 10/2006
EP 1707393 10/2006
EP 1 719 628 11/2006
JP 62-82062 4/1987
JP 62082062 A * 4/1987
JP 62-142669 6/1987
JP 6-242364 9/1994

(Continued)

OTHER PUBLICATIONS

Korean Office Action issued on Aug. 19, 2009 in corresponding Korean Patent Application No. 10-2008-0018619.

(Continued)

*Primary Examiner* — Daniel J Colilla
(74) *Attorney, Agent, or Firm* — Staas & Halsey LLP

(57) ABSTRACT

A printing apparatus having shorter length in the longitudinal direction and a dust-protecting feature is disclosed. The printer includes a main frame, a subframe assembly, first and second pulse motors each have a reduction gear drive mechanism, a thermal head, a platen roller, a rotary blade, and a stationary blade. The first motor for driving the platen roller and the second motor for driving the rotary blade are disposed between two side plates provided one on each end of the main frame. The reduction gear drive mechanisms are substantially sealed and disposed inside the corresponding side plates. Two pulleys and a timing belt are provided outside each of the side plates.

14 Claims, 22 Drawing Sheets

(56) References Cited

FOREIGN PATENT DOCUMENTS

| | | | | |
|---|---|---|---|---|
| JP | 08061437 | A | * | 3/1996 |
| JP | 2001206620 | A | * | 7/2001 |
| JP | 2002283631 | A | * | 10/2002 |
| JP | 2005-74598 | | | 3/2003 |
| JP | 2003237121 | A | * | 8/2003 |
| JP | 2005-81774 | | | 3/2005 |
| JP | 2005238592 | A | * | 9/2005 |
| JP | 2006352969 | A | * | 12/2006 |
| WO | WO 2005082634 | A1 | * | 9/2005 |

OTHER PUBLICATIONS

Extended European Search Report dated Nov. 5, 2011 in application No. 08101231.2.
Patent Abstracts of Japan, Publication No. 62-82062, published Apr. 15, 1987.
Patent Abstracts of Japan, Publication No. 2005-74598, published Mar. 24, 2005.
English Abstract of JP 62-142669, published Jun. 26, 1987.
English Abstract for Japanese Publication No. 6-242364, published Sep. 2, 1994.

* cited by examiner

PRINTING APPARATUS WITH SEALED GEAR DRIVE MECHANISM

BACKGROUND OF THE INVENTION

1. Field of the Invention

The present invention generally relates to a printing apparatus and, more specifically, to a printing apparatus having a thermal head, a platen roller pressing a sheet against the thermal head, and a printing apparatus having the thermal head, the platen roller, and a cutting device for cutting a printed sheet.

2. Description of the Related Art

FIG. 1 shows a typical conventional thermal printing apparatus 1. The thermal printing apparatus 1 includes a printer main body 2 and a module 20 mounted on the printer main body 2. It should be noted that, in the accompanying figures, the arrows, X1-X2, Y1-Y2, and Z1-Z2 indicate the longitudinal, the depth, and the height directions, respectively, of the thermal printing apparatus 1.

As shown in FIGS. 1 through 3, the printer main body 2 includes a frame 3 having its side plates 3X1 and 3X2, a first pulse motor 4 for driving a platen roller and a second pulse motor 5 for driving a cutting device, a thermal head 6 and a stationary blade 7 each provided in the middle of the frame 3, first and second reduction gear drive mechanisms 8 and 9, and covers 10 and 11. The first and the second reduction gear drive mechanisms 8 and 9 reduce the rotational speed of the first and the second pulse motors 4 and 5 and transmit the rotational motion to the outside of the side plates 3X1 and 3X2 of the frame 3, and are covered by the covers 10 and 11, respectively.

Grease is applied to the reduction gear drive mechanisms 8 and 9. As shown in FIG. 2, the gears 12 and 13 of the first and the second reduction gear drive mechanisms 8 and 9 are the final gears of the first and the second reduction gear drive mechanisms 8 and 9, respectively. The covers 10 and 11 have openings 10*a* and 11*a* in the vicinity of the gears 12 and 13, respectively.

As shown in FIG. 1, the module 20 includes a frame 21, a platen roller 22 rotatably mounted on the frame 21 and having a gear 24 on one end, a movable blade 23 slidably mounted on the frame 21, and a reduction gear drive mechanism 25 mounted on the flange of the platen roller 22. The reduction gear drive mechanism 25 includes gears 26, 27, and 28. The gear 28 is the final gear meshed with a rack 29 integrally formed with the movable blade 23.

The printing apparatus 1 is configured by mounting the module 20 on the printer main body 2. When the module 20 is mounted on the printer main body 2, the platen roller 22 is pressed against the thermal head 6 with a sheet interposed in between, the movable blade 23 faces the stationary blade 7, and the gears 24 and 25 are meshed with the gears 12 and 13, respectively.

When a printing instruction is issued, the thermal head 6 and the first pulse motor 4 are driven so as to rotate the platen roller 22 through the reduction gear drive mechanism 8 and the gear 24, print a sheet by the thermal head 6, and feed the sheet by the platen roller 22. When a cutting instruction is issued, the second pulse motor 5 is driven so as to move the movable blade 23 through the reduction gear drive mechanisms 8 and 25 and the rack 29, and cut the fed sheet from the printer apparatus 1.

Patent Document 1: Japanese Patent Application Publication No.: 2005-081774

However, there is a problem that since there are the openings 10*a* and 11*a* formed on the covers 10 and 11 covering the reduction gear drive mechanisms 8 and 9, respectively, when the printing apparatus 1 is used in a dusty working environment, the reduction gear drive mechanisms 8 and 9 are susceptible to dust contamination, thereby easily wearing the gears to shorten the service life. Also, disadvantageously, the grease applied to the reduction gear drive mechanisms 8 and 9 attracts and contains the dust entering inside the covers 10 and 11, thereby accelerating the wearing of the gears. When the wearing of the gears proceeds, the service life of the printing apparatus 1 becomes shorter accordingly.

Further, as shown in FIG. 2, there is another problem that since the reduction gear drive mechanisms 8 and 9 are disposed outside the side plates 3X1 and 3X2, respectively, the length L2 extended outward from the flanges 2*a* and 2*b* reaches about 20 mm. As a result, the length L1 in the longitudinal direction disadvantageously reaches about 130 mm.

On the other hand, this type of thermal printing apparatus 1 is often embedded in a portable ticketing system and the length L1 in the longitudinal direction of the printing apparatus 1 substantially defines the width of the portable ticketing system. However, there is a demand for reducing the size of portable ticketing systems to make them more portable. Therefore, the length L1 in the longitudinal direction of the printing apparatus 1 is required to be reduced as much as possible.

SUMMARY OF THE INVENTION

The present invention is provided in light of the above problems and may provide a printing apparatus capable of resolving the problems.

According to one aspect of the present invention, there is provided a printing apparatus including a frame, a thermal head mounted on the frame and provided for printing, a platen roller mounted on the frame and provided for pressing a sheet against the thermal head, a first motor for driving the platen roller, and a first reduction gear drive mechanism provided for reducing and transmitting the rotation of the first motor to the platen roller, wherein the first reduction gear drive mechanism is substantially sealed.

According to this aspect of the present invention, since the reduction gear drive mechanism is substantially sealed, even when the printing apparatus is used in a dusty working environment including fine sand, the thermal printing apparatus is hard to be influenced by the dust, for example, the teeth of the gears are hardly worn. As a result, the thermal printing apparatus has a longer service life.

According to another aspect of the present invention, there is provided a printing apparatus including a frame having a side plate, a thermal head mounted on the frame and provided for printing, a platen roller mounted on the frame and provided for pressing a sheet against the thermal head, a first motor mounted on the frame and provided for driving the platen roller, and a first reduction gear drive mechanism provided inside the side plate of the frame and provided for reducing and transmitting the rotation of the first motor to the platen roller.

According to this aspect of the present invention, there is a space between the side plates in a conventional printing apparatus and the space can be effectively used by disposing the reduction gear drive mechanism inside the side plate. Accordingly, it is possible to reduce the size beyond the side plate, thereby reducing the size of the printing apparatus to make it more portable.

DETAILED DESCRIPTION OF THE PREFERRED EMBODIMENTS

Next, embodiments of the present inventions are described.

Embodiment 1

Figure 1:
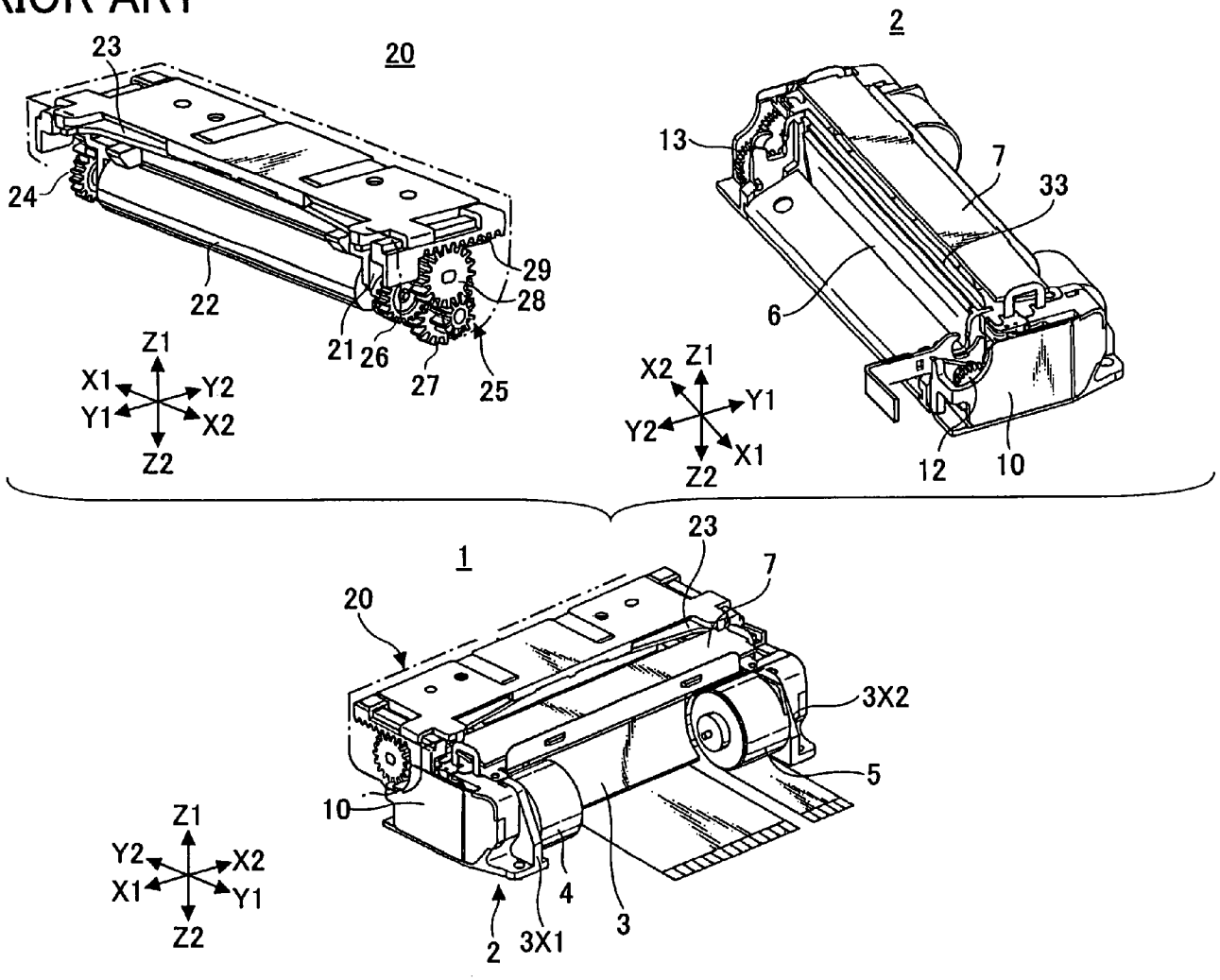
FIG.1 PRIOR ART
FIG. 1 is a drawing showing a conventional thermal printing apparatus.
Figure 2:
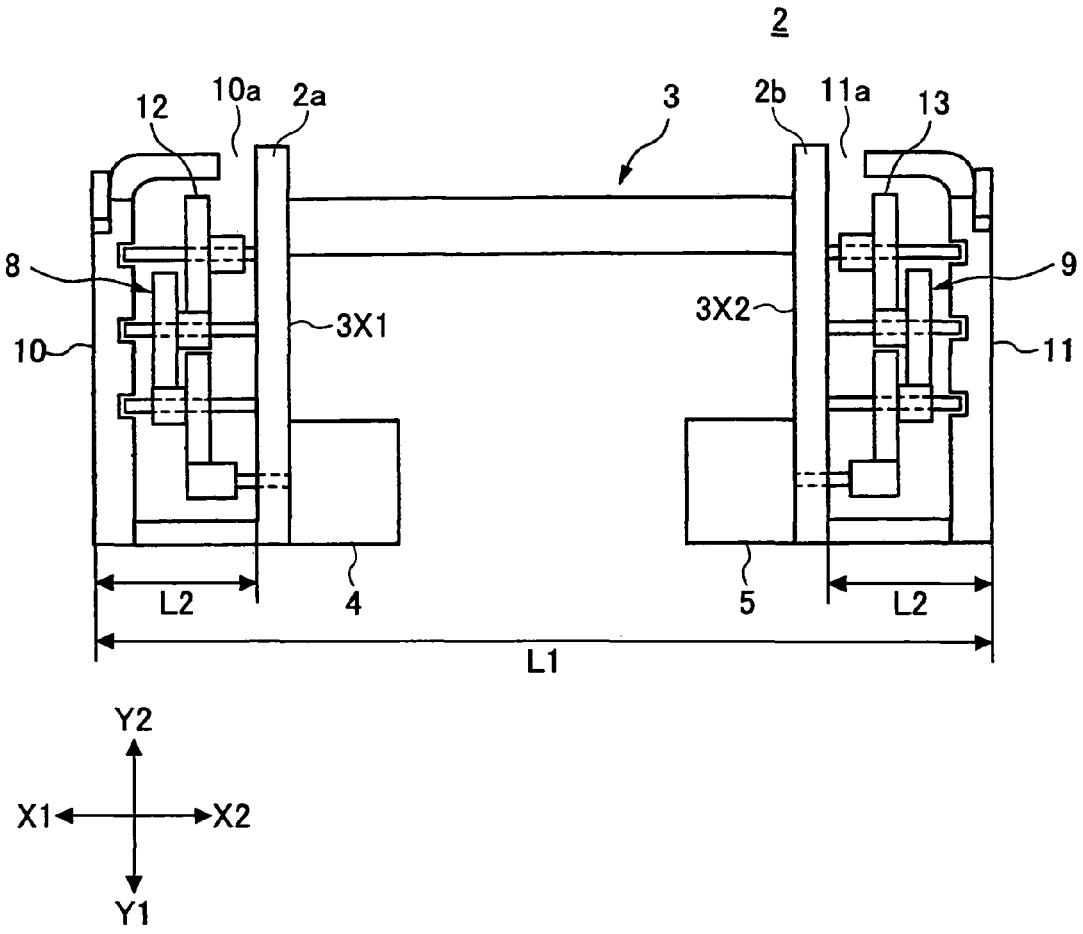
FIG.2 PRIOR ART
FIG. 2 is a drawing schematically showing the printer main body of the thermal printing apparatus in FIG. 1.
Figure 3:
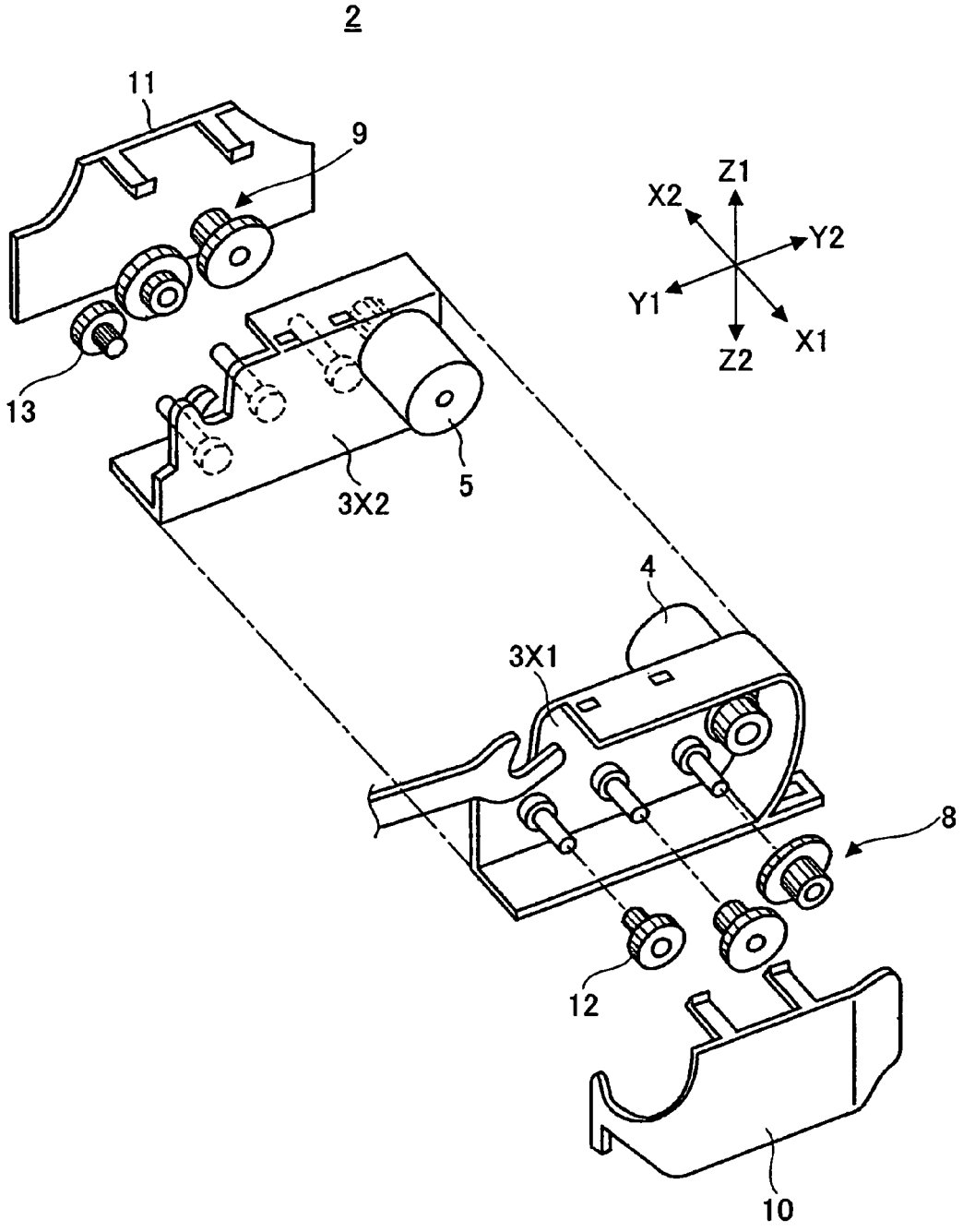
FIG.3 PRIOR ART
FIG. 3 is an exploded perspective view schematically showing a reduction gear drive mechanism reducing and transmitting the rotation of the pulse motor of the thermal printing apparatus in FIG. 2.
Figure 4:
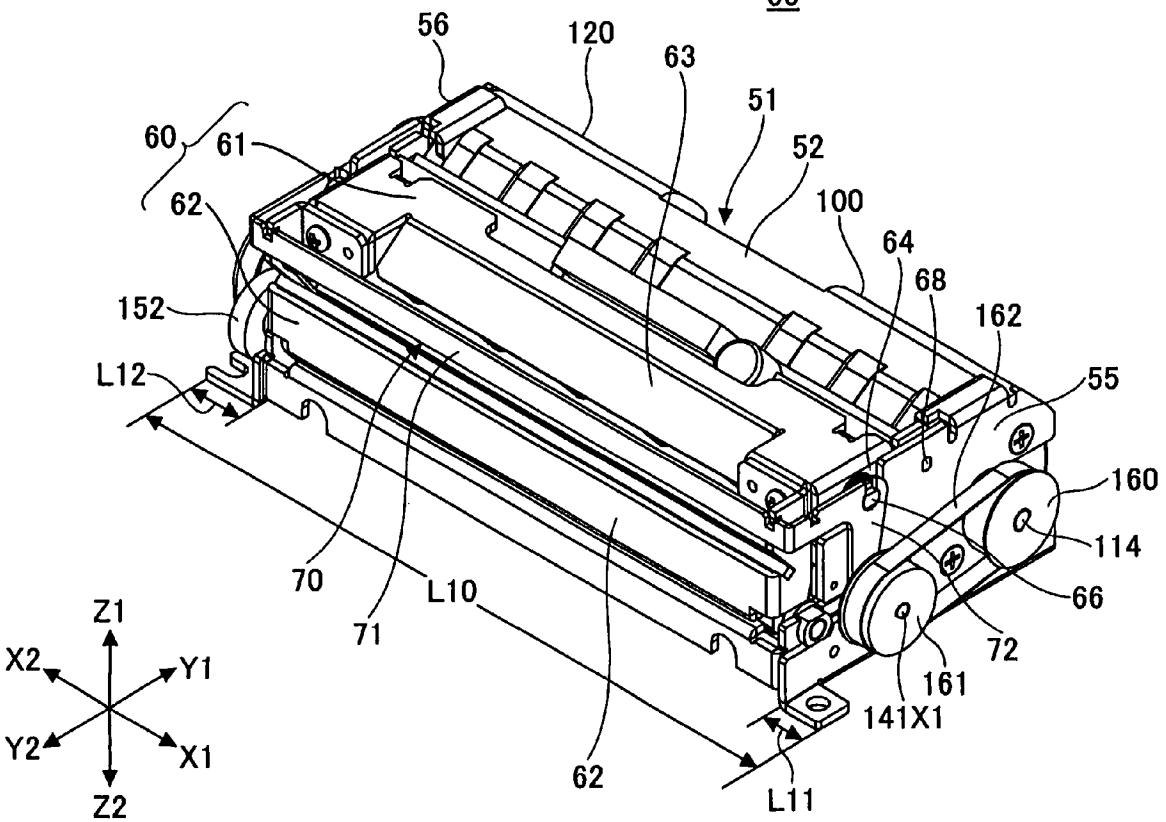
FIG. 4 is a perspective view showing a thermal printing apparatus according to a first embodiment of the present invention.
Figure 5:
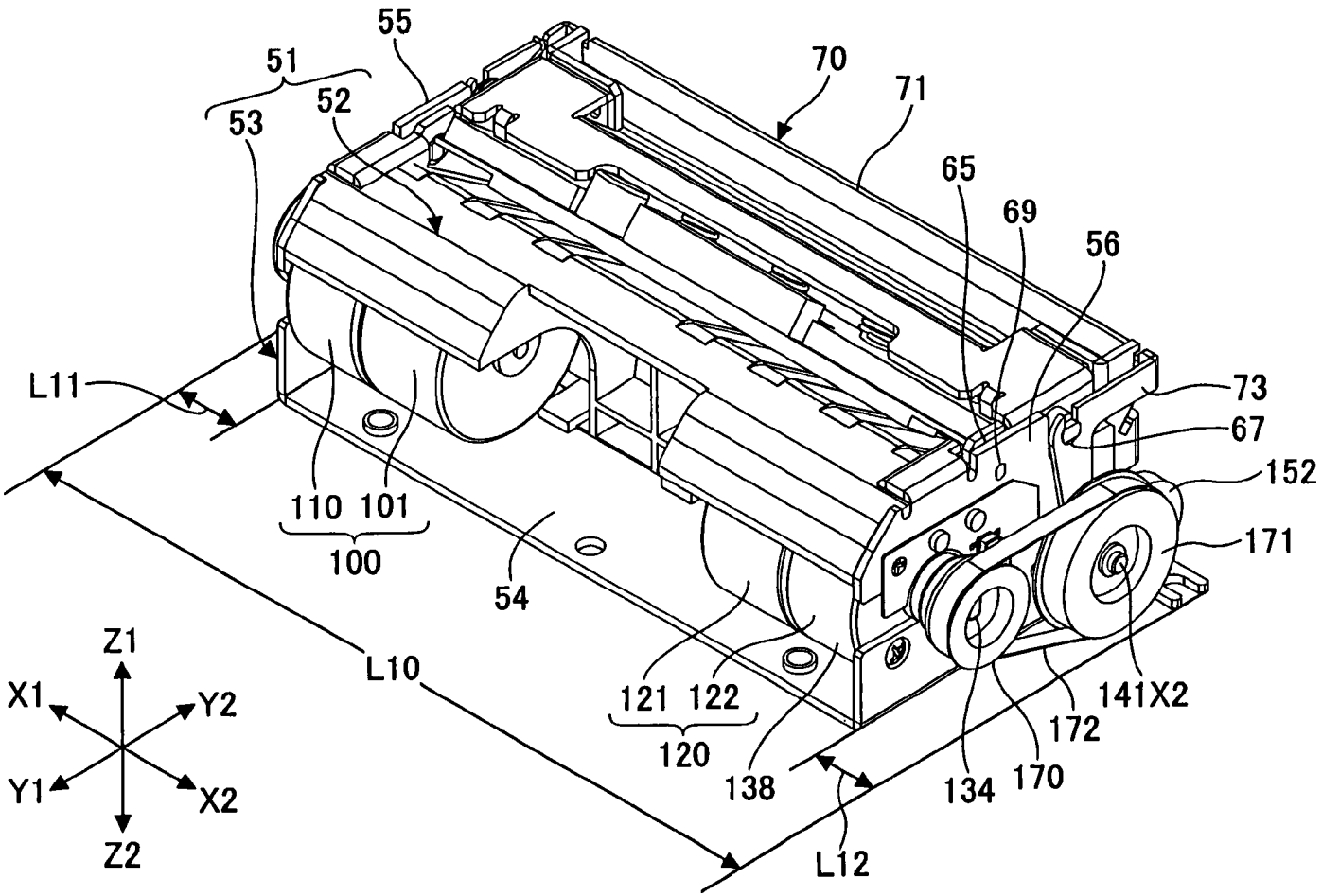
FIG. 5 is an oblique upper rear side perspective view of the thermal printing apparatus in FIG. 4.
Figure 6:
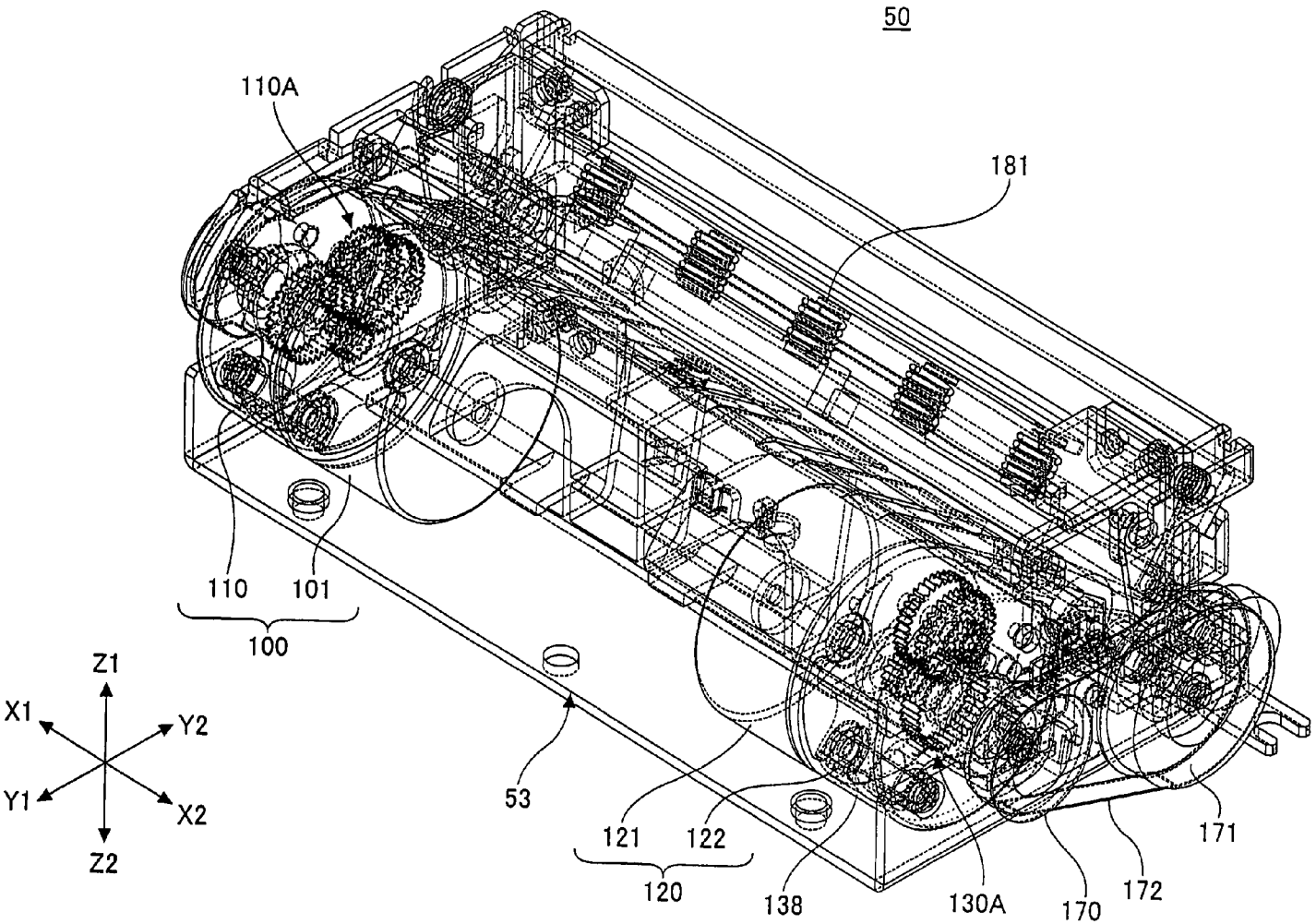
FIG. 6 is a transparent perspective view of the thermal printing apparatus in FIG. 5.
Figure 7:
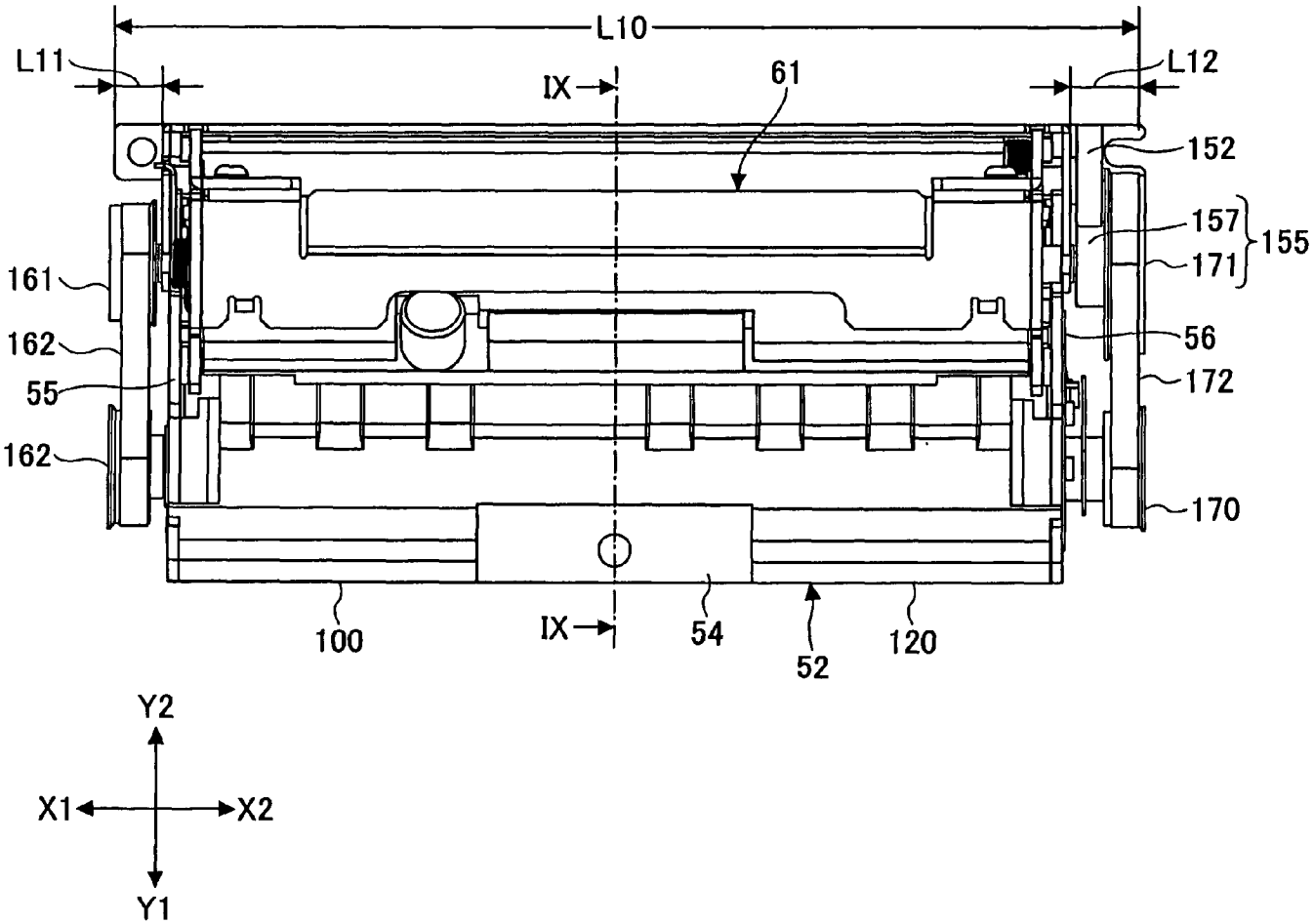
FIG. 7 is a plan view of the thermal printing apparatus in FIG. 5.
Figure 8:
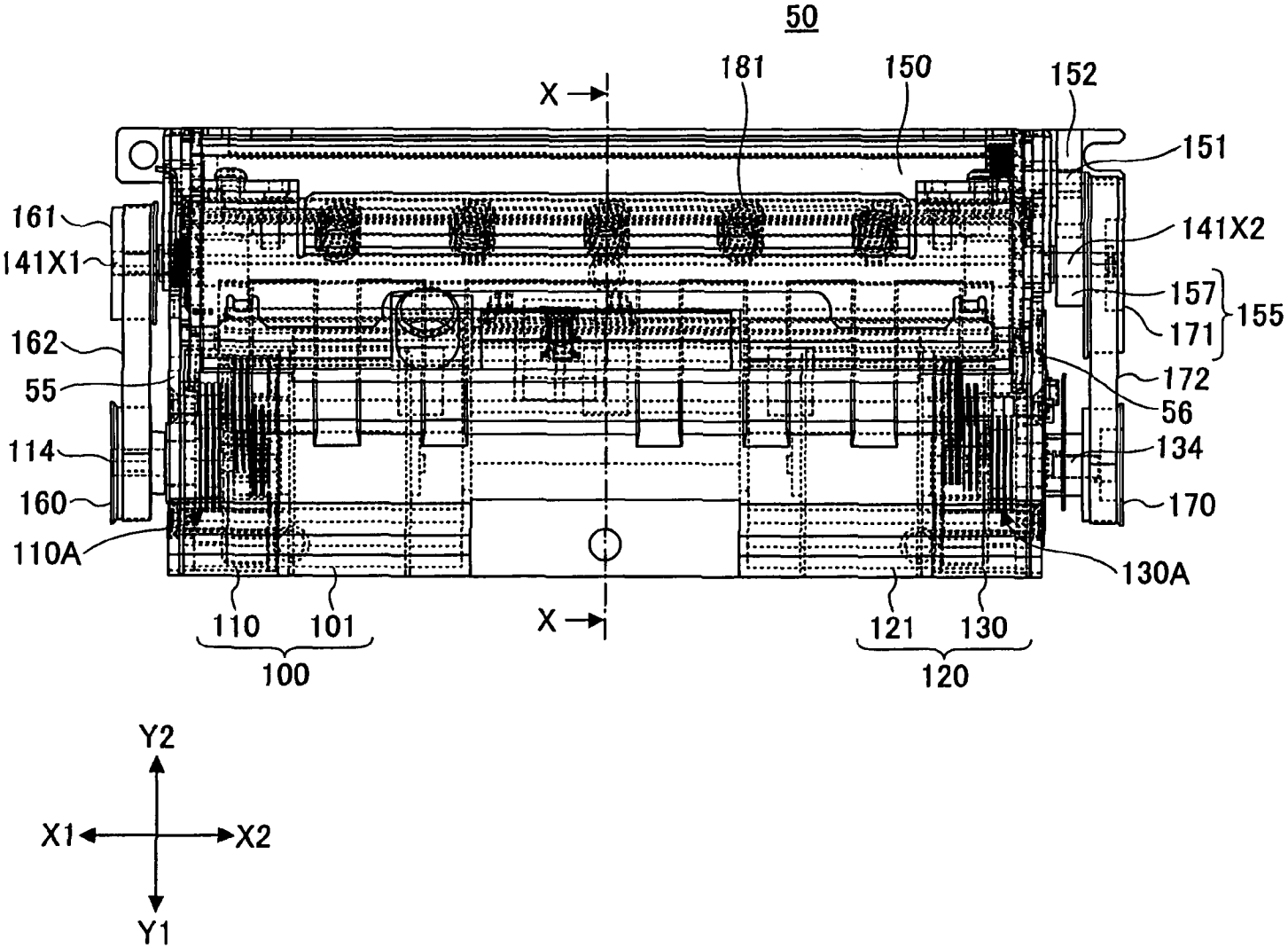
FIG. 8 is a transparent plan view of the printing apparatus in FIG. 7.
Figure 9:
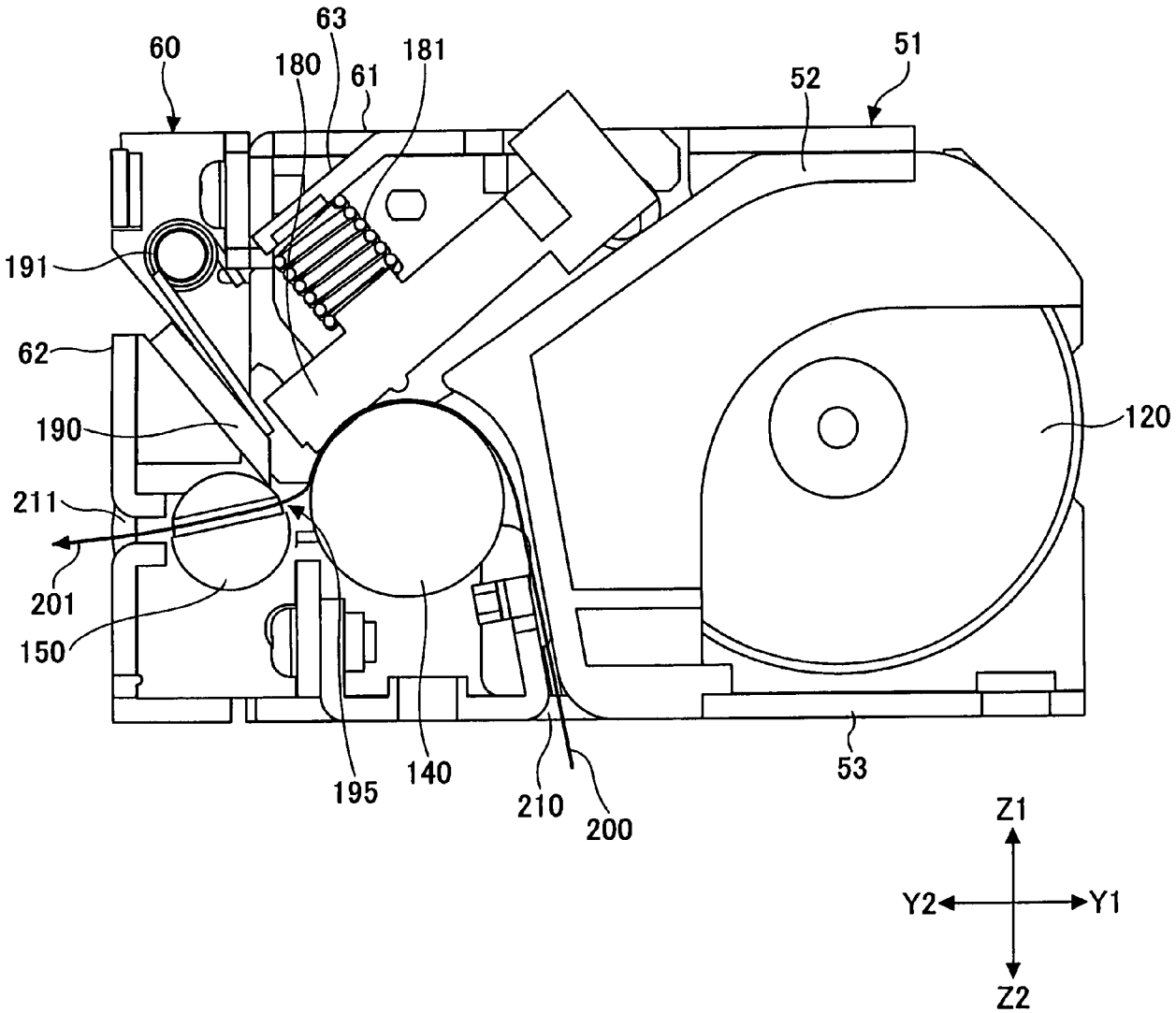
FIG. 9 is a cut-open view along the line IX-IX of the printing apparatus in FIG. 7.
Figure 10:
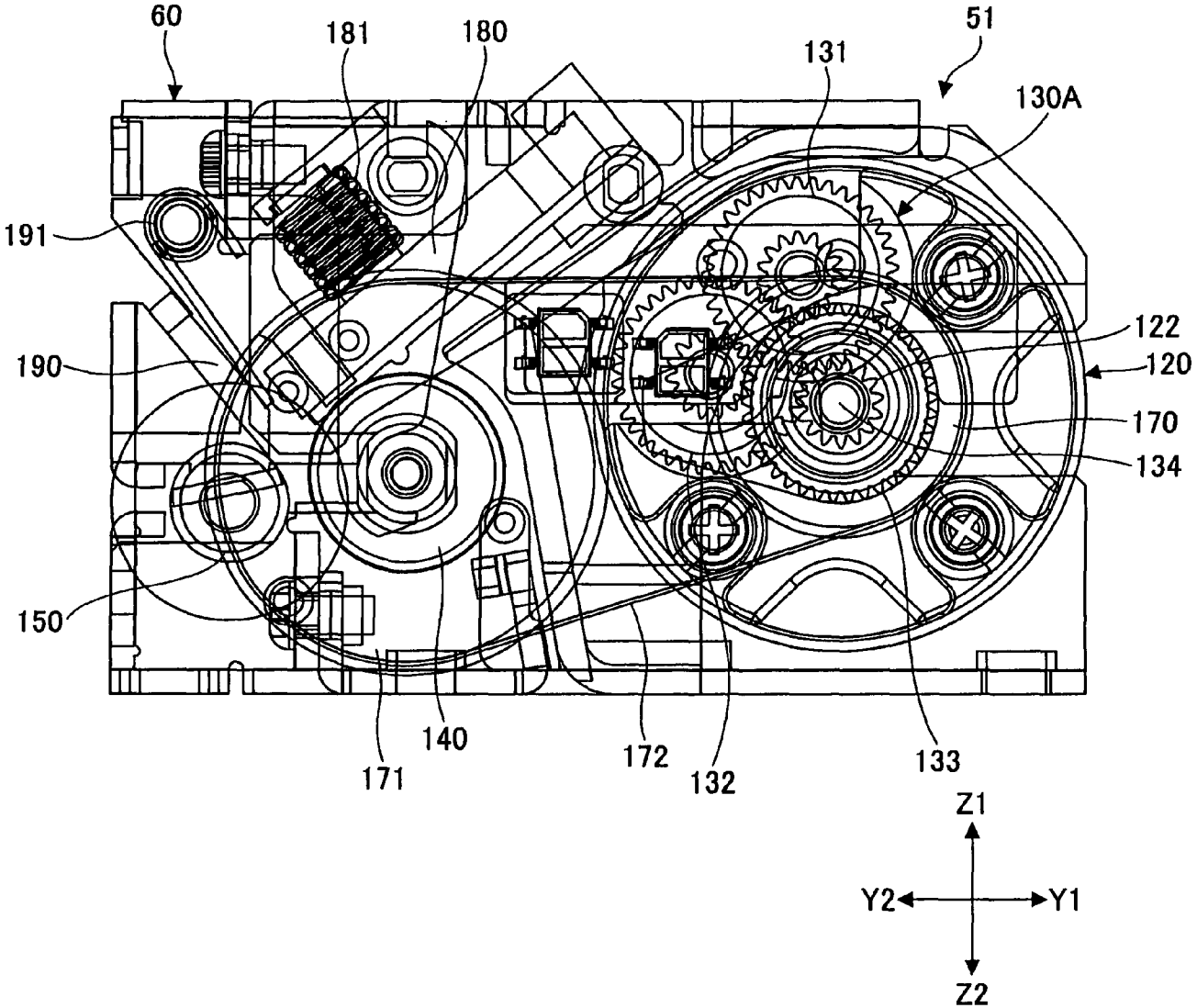
FIG. 10 is a cut-open view along the line X-X of the printing apparatus in FIG. 8.

FIG. 4 is a perspective view showing a thermal printing apparatus 50 according to a first embodiment of the present invention. FIG. 5 is a perspective view of the thermal printing apparatus 50 when viewed from an oblique upper rear side. FIG. 6 is a transparent perspective view of the thermal printing apparatus 50. FIG. 7 is a plan view of the thermal printing apparatus 50. FIG. 8 is a transparent plan view of the printing apparatus 50. FIG. 9 is a cut-open view along the line IX-IX of the printing apparatus in FIG. 7. FIG. 10 is a cut-open view along the line X-X of the printing apparatus in FIG. 8. FIGS. 11 through 14 show the thermal printing apparatus 50 when the clam-shell of the thermal printing apparatus 50 is open.

In the figures, the arrows, X1-X2, Y1-Y2, and Z1-Z2 indicate the longitudinal, the depth, and the height directions, respectively, of the thermal printing apparatus 50.

The thermal printing apparatus 50 includes its reduction gear drive mechanism disposed between the side plates of the frame of the thermal printing apparatus so that the length L10 in the longitudinal direction of the thermal printing apparatus 50 is shorter than the corresponding length L1 of a conventional thermal printing apparatus.

[Schematic Structure of the Thermal Printing Apparatus 50]

The thermal printing apparatus 50 generally includes a main frame 51, a subframe assembly 60, a lock member 70, two pulse motors 100 and 120 that each have a reduction gear drive mechanism head, a thermal head 180, a platen roller 140, a rotary blade 150, and a stationary blade 190. The platen roller 140 is disposed below the thermal head 180 and the rotary blade 150 is disposed below the stationary blade 190. The thermal printing apparatus 50 has a clam-shell structure in which the subframe assembly 60 rotates with respect to the main frame 51 so that the thermal head 180 and the stationary blade 190 separate from the platen roller 140 and the rotary blade 190, respectively.

The platen roller 140, the rotary blade 150, the pulse motor 100 (a first motor) provided for driving the platen roller 140 and having the reduction gear drive mechanism head, and the pulse motor 120 (a second motor) provided for driving the rotary blade 150 and having the reduction gear drive mechanism head are mounted between side plates 55 and 56 provided one on each end of the main frame 51.

Pulleys 160 and 161 for timing belt and a timing belt 162 are disposed outside the side plate 55 of the main frame 51. Similarly, pulleys 170 and 171 for timing belt and a timing belt 172 are disposed outside the side plate 56 of the main frame 51 (see FIG. 7).

As shown in FIG. 9, the thermal head 180 and the stationary blade 190 are mounted on the subframe assembly 60.

Figure 11:
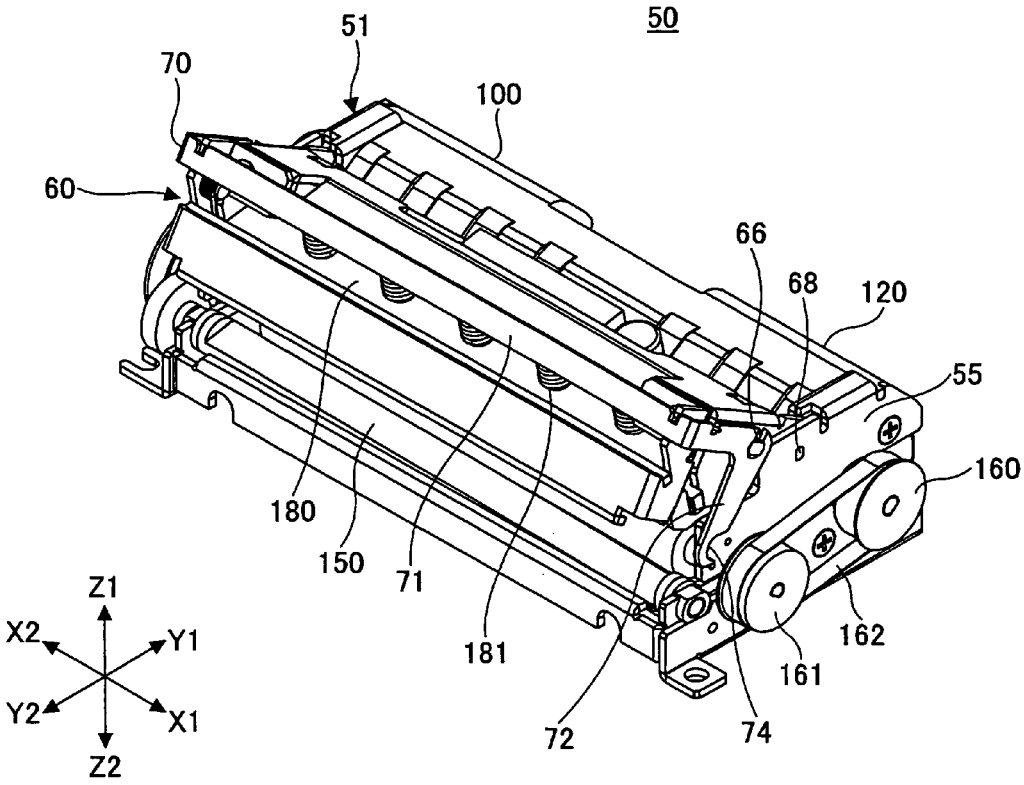
FIG. 11 is a perspective view of the thermal printing apparatus when the clam-shell of the thermal printing apparatus is open.
Figure 12:
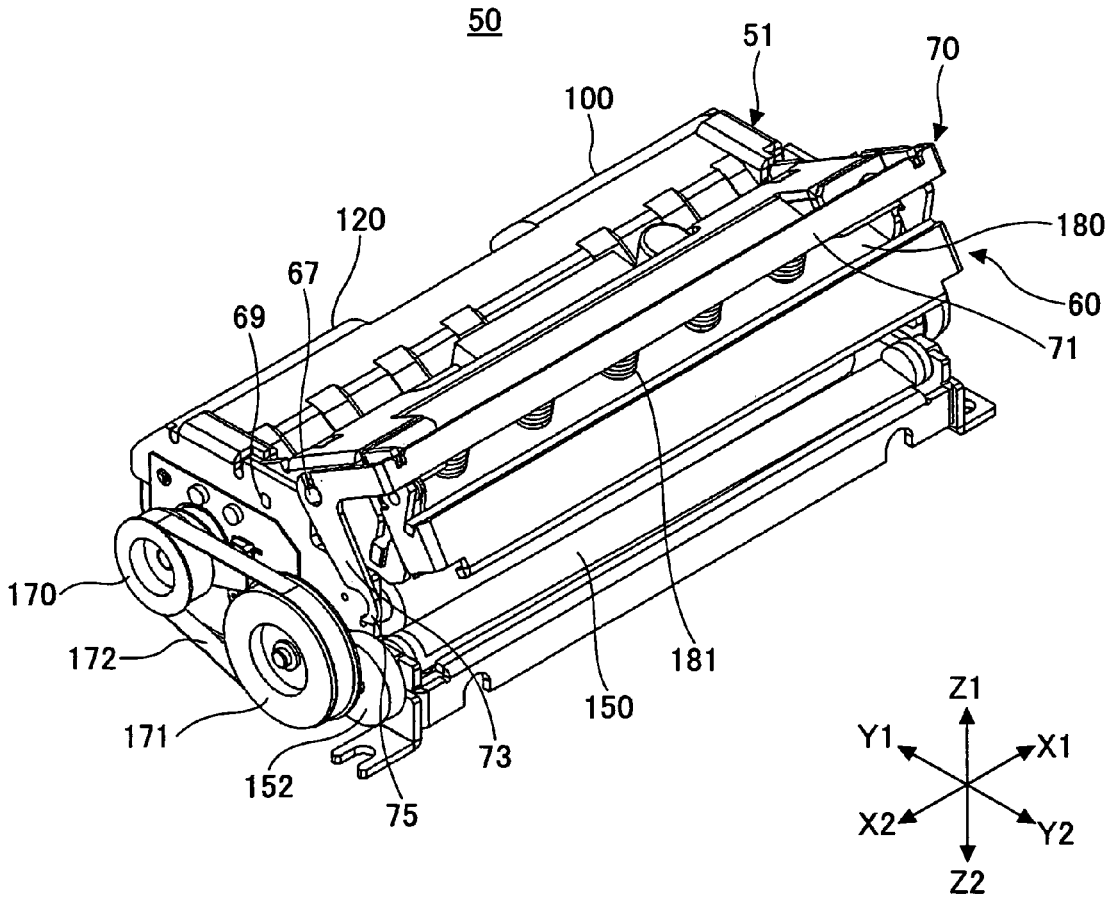
FIG. 12 is another perspective view of the thermal printing apparatus when the clam-shell is open.
Figure 13:
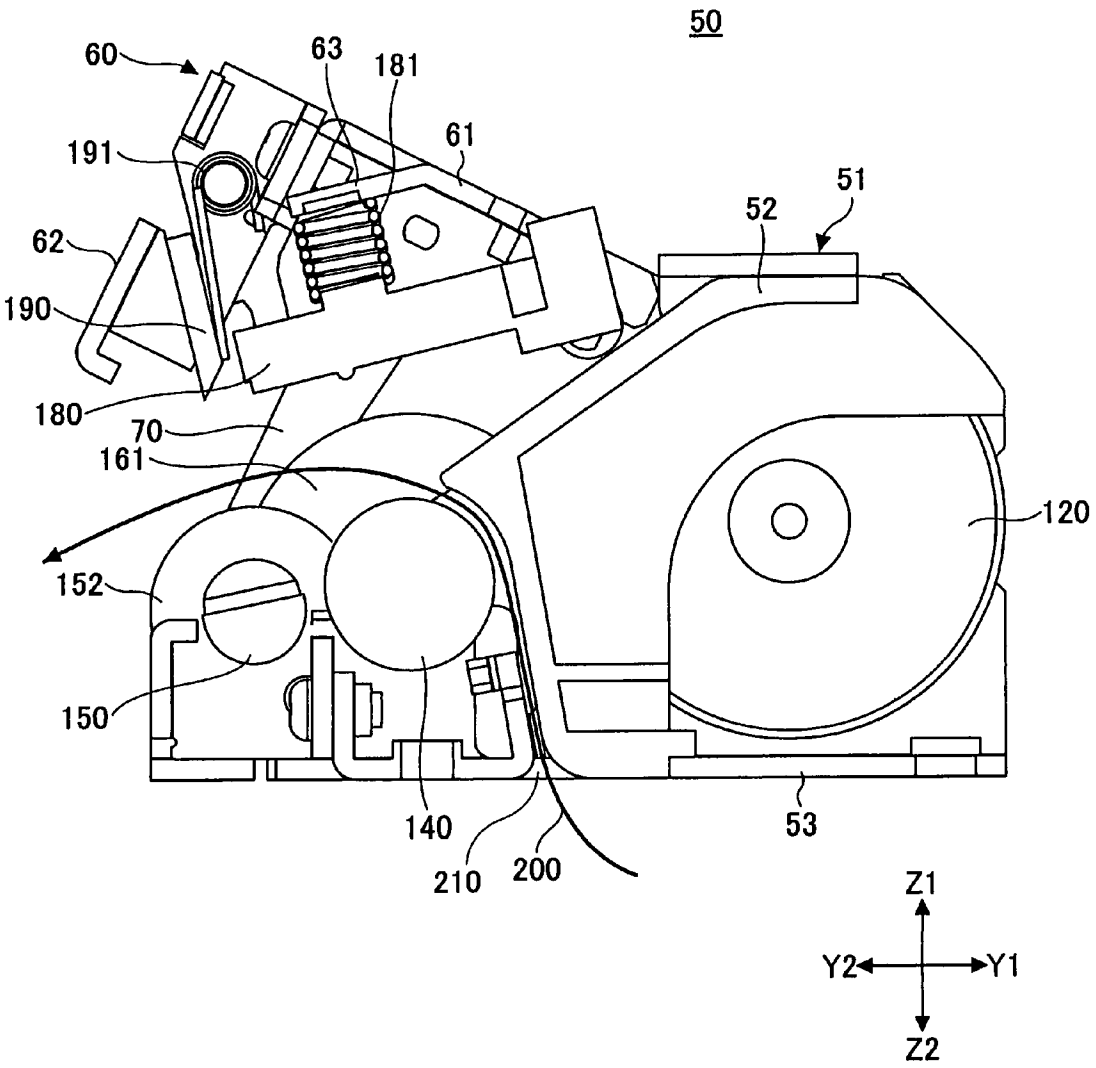
FIG. 13 is a cut-open view of the thermal printing apparatus when the clam-shell is open.
Figure 14:
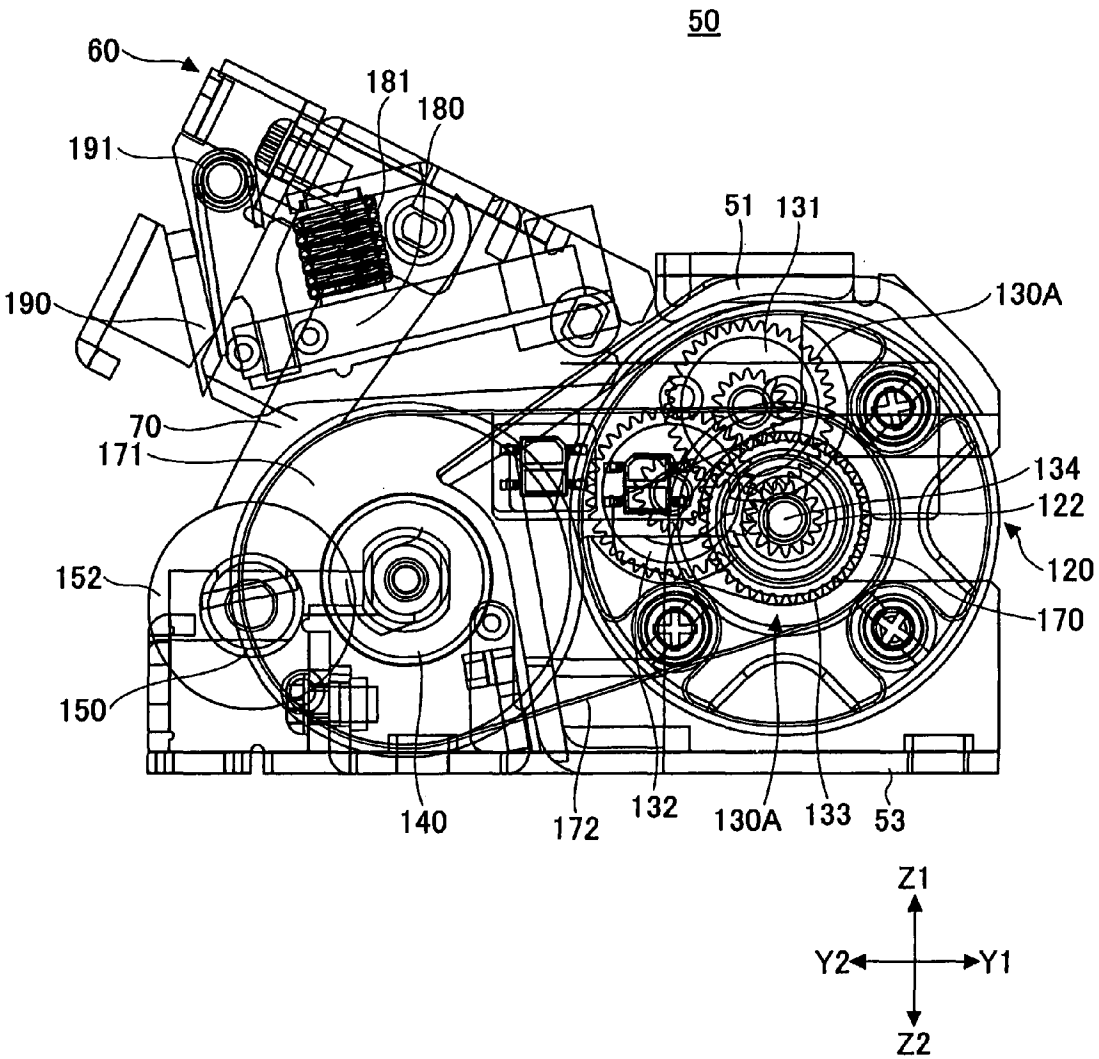
FIG. 14 is a transparent cut-open view of the thermal printing apparatus when the clam-shell is open.

When the subframe assembly (clam-shell) 60 is open as shown in FIGS. 11 through 14, a thermal paper 200 is inserted from the bottom side of the thermal printing apparatus 50 as shown in FIG. 13. Then, when the subframe 60 is closed, the thermal head 180 is pressed against the platen roller 140 with the inserted thermal paper 200 interposed in between and the stationary blade 190 approaches the rotary blade 150 so as to configure a cutting device 195, thereby enabling the printing and the cutting operations.

In this configuration, since the reduction gear drive mechanisms are disposed in between the side plates 55 and 56, only the pulleys 160 and 161 and the timing belt 162 are disposed outside the side plate 55 and only the pulleys 170 and 171 and the timing belt 172 are disposed outside the side plate 56. Because of this structure, the lengths L11 and L12 extending outward from the side plates 55 and 56, respectively, are only about 9 mm each, which is shorter than the corresponding lengths about 15 mm each of a conventional thermal printing apparatus. As a result, the longitudinal length of the thermal printing apparatus 50 is shorter than that of a conventional thermal printing apparatus by about 12 mm, thereby reducing the size of the thermal printing apparatus.

It should be noted that though the length of the pulse motors 100 and 120 each of which have the reduction gear drive mechanism head is longer than that of a pulse motor having no reduction gear drive mechanism head, since there is a dead space between the pulse motors in a conventional printing apparatus, it is possible to dispose the pulse motors 100 and 120 that each have the reduction gear drive mechanism head of the thermal printing apparatus 50 at the places where the pulse motors are disposed in a conventional thermal printing apparatus.

Further, since the reduction gear drive mechanism is sealed inside its head, the reduction gear drive mechanism is hard to be influenced by dust. Therefore, the thermal printing apparatus 50 has a longer service life even when used in a dusty working environment including fine sand.

It should be noted that dust may intrude and be attached to the pulleys 160 and 161 and the timing belt 162 as well as the pulleys 170 and 171 and the timing belt 172. However, the dust attached in between the pulley and the timing belt is soft enough to be rubbed into the surface of the timing belt, thereby reducing the wearing of the pulleys. From this point of view as well, the thermal printing apparatus 50 has a longer service life.

[Structure of the Frame]

The frame of the thermal printing apparatus 50 includes the main frame 51, the subframe assembly 60, and the lock member 70.

The main frame 51 includes a base member 53 and a guide frame 52 made of formed plastic. The base member 53 includes a bottom plate 54 and side plates 55 and 56 provided one on each end of the bottom plate 54. After the guide frame 52 is disposed inside the base member 53, the guide frame 52 and the base member 53 are fixed to each other with screws as shown in FIG. 5.

The subframe assembly 60 includes a first subframe 61 and a second subframe 62 fixed to the first subframe 61 with screws. The first subframe 61 includes a cross bar 63 elongated in the X direction and arms 64 and 65 each protruding in the same direction one from each end of the cross bar 63. The arms 64 and 65 have pins 66 and 67 attached to the arms 64 and 65, respectively (see FIG. 5). The stationary blade 190 described below is fixed to the second subframe 62. Further, the second subframe 62 has a role to cover the rotary blade 150 for securing safety (see FIG. 9).

The arms 64 and 65 of the subframe assembly 60 are rotatably mounted on the side plates 55 and 56 with pins 68 and 69, respectively, so that the top of the arms 64 and 65 rotate reciprocally within a prescribed angle range (see FIG. 4).

The lock member 70 is used to lock the subframe assembly 60 with respect to the main frame 51 to keep the closed condition of the subframe assembly 60 and includes a cross bar 71 elongated in the X direction and L-shaped arms 72 and 73 protruding in the same direction from each end of the cross bar 71. The lock member 70 is disposed so as to surround the outside of the subframe 61 and is rotatably mounted on the subframe 61 with pins 66 and 67 provided in the middle of the arms 72 and 73, respectively (see FIG. 11). The arms 72 and 73 have hooks 74 and 75 at the top of the arms 72 and 73, respectively.

[Structure of the Pulse Motor 100 Having a Reduction Gear Drive Mechanism Head]

Figure 15:
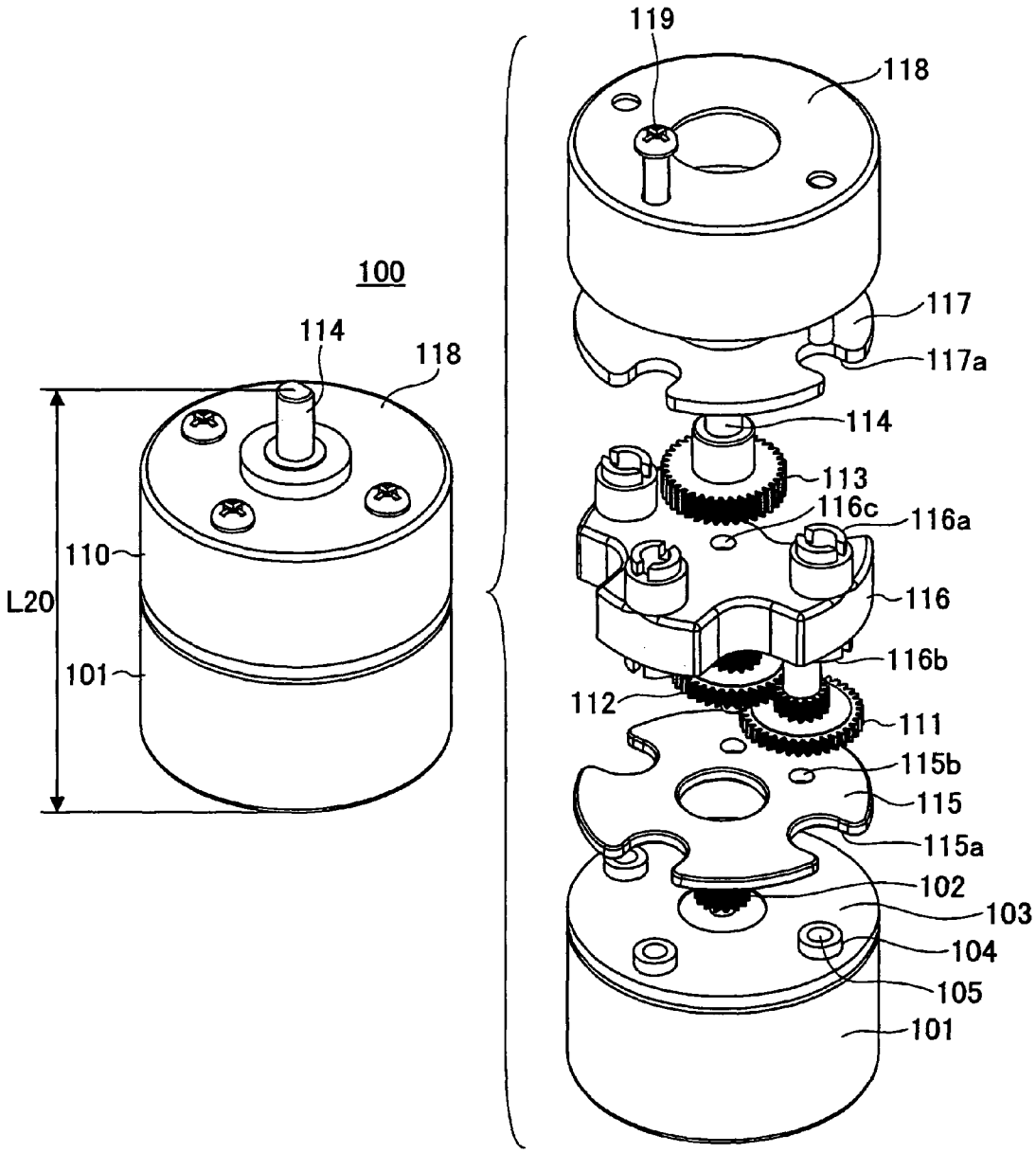
FIG. 15 is an exploded perspective view of the reduction gear drive mechanism part inside the reduction gear drive mechanism head mounted on the pulse motor.
Figure 16:
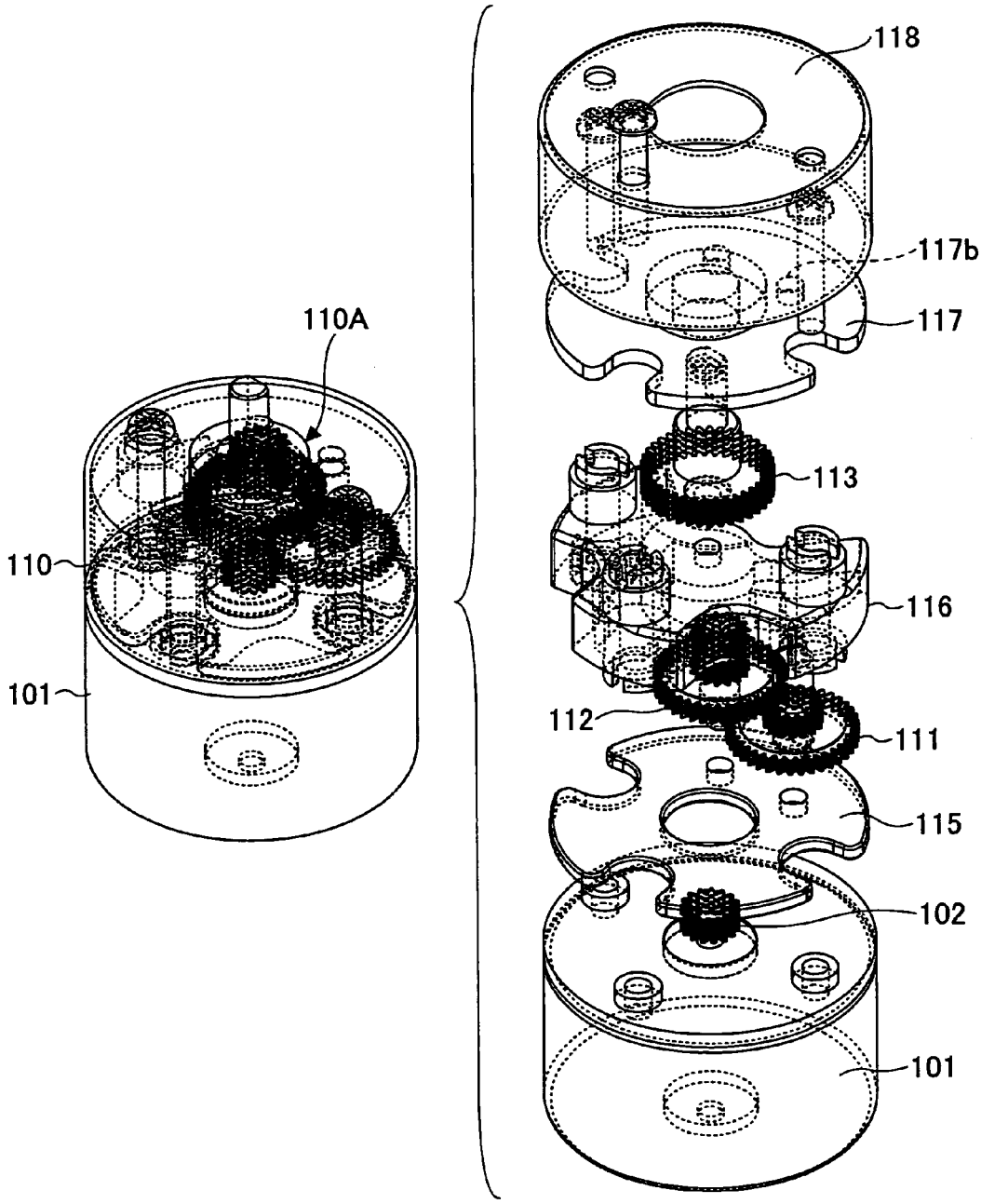
FIG. 16 is an exploded perspective transparent view of the reduction gear drive mechanism part inside the reduction gear drive mechanism head mounted on the pulse motor.
Figure 17:
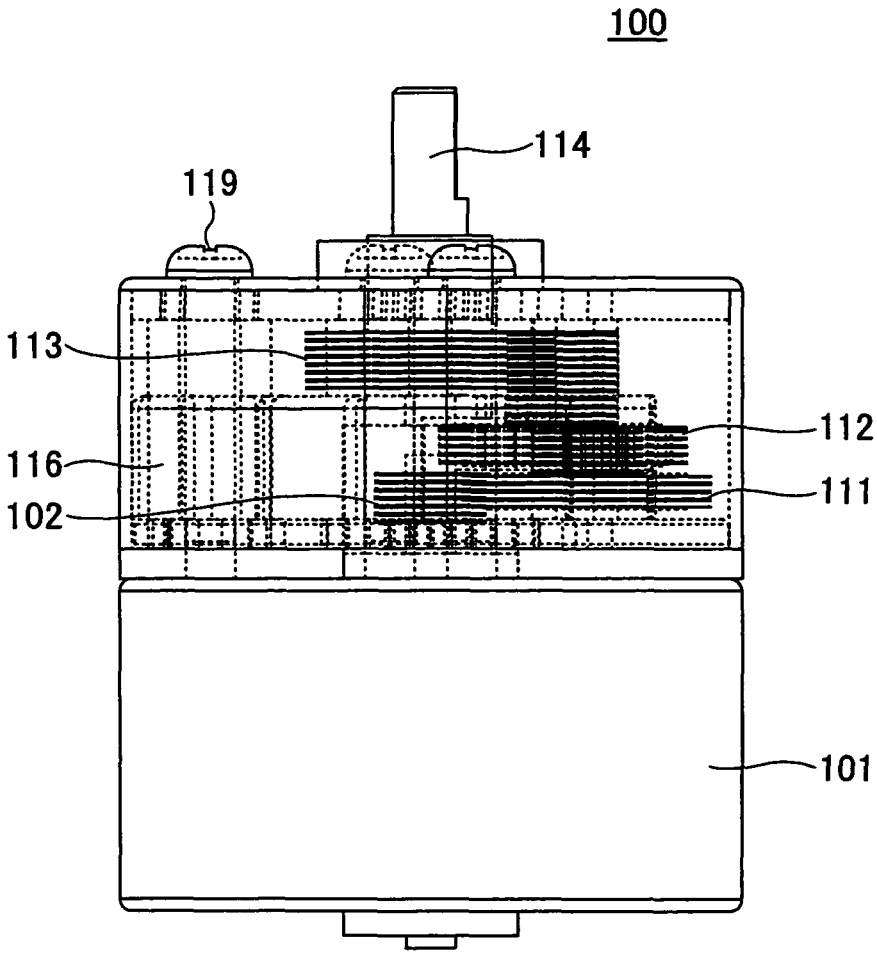
FIG. 17 is a cut-open view of the pulse motor having the reduction gear drive mechanism head.
Figure 18:
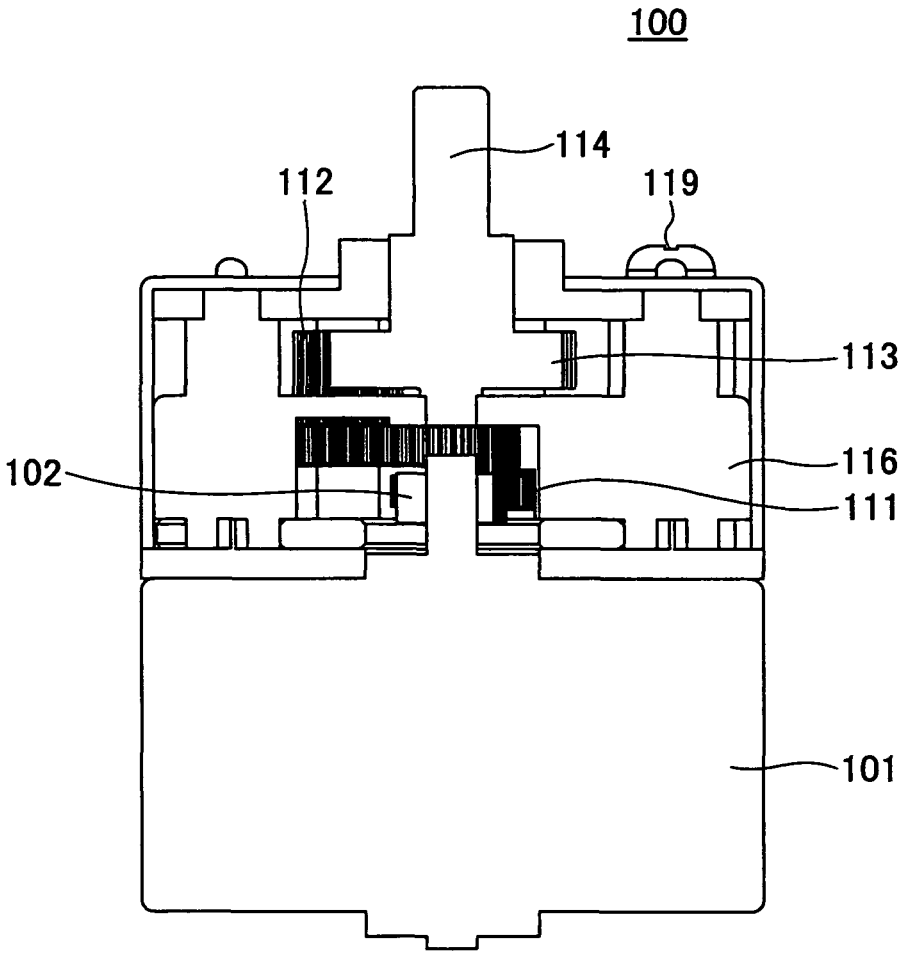
FIG. 18 is another cut-open view taken through another surface of the pulse motor having the reduction gear drive mechanism head.

FIG. 15 is an exploded perspective view of the reduction gear drive mechanism part of the reduction gear drive mechanism head mounted on the pulse motor 100. FIG. 16 is an exploded perspective transparent view of the reduction gear drive mechanism part of the reduction gear drive mechanism head mounted on the pulse motor 100. FIGS. 17 and 18 are cut-open views of the pulse motor 100 having the reduction gear drive mechanism head.

As shown in FIGS. 15 through 18, the pulse motor 100 having the reduction gear drive mechanism head (first motor) includes a pulse motor main body 101 and a reduction gear drive mechanism head 110 integrally mounted on the pulse motor main body 101, and has the longitudinal length L20 (see FIG. 15).

The pulse motor main body 101 has an output gear 102 and bracket 103 each provided on the same end of the pulse motor main body 101. The bracket 103 includes three protruding portions 104 each having an inner screw hole 105 formed therethrough.

The reduction gear drive mechanism head 110 includes a reduction gear drive mechanism 110A. The reduction gear drive mechanism 110A includes a first, a second, and a third gears 111, 112, and 113. The first and the second gears 111 and 112 are two-stage gears that each have an axle extending in both the upper and the lower directions. The third gear 113 has an output axle 114 extending in the upper direction and an axle extending in the lower direction.

The reduction gear drive mechanism head 110 further includes a lower plate 115, a spacer 116, an upper plate 117, and a cap 118 (first cap), as shown in FIG. 16.

The spacer 116 has a shape so as not to interfere with the first and the second gears 111 and 112, and has three protruding portions 116*a* on the upper surface, corresponding three protruding portions 116*b* on the lower surface, and a hole 116*c* in the center of the upper surface. Through holes are formed through each of the protruding portions 116*a* and the corresponding protruding portion 116*b*.

The lower plate 115 includes three concave portions 115*a* corresponding to the protruding portions 116*b*, and two holes 115*b* for supporting the gears 111 and 112.

The upper plate 117 includes three concave portions 117*a* corresponding to the protruding portions 116*a*, and two holes 117*b* for supporting the gears 111 and 112.

The reduction gear drive mechanism head 110 is assembled by placing the lower plate 115 on the bracket 103 in a manner so that the concave portions 115*a* fit the protruding portions 104 of the bracket 103, placing the spacer 116 and the first and the second gears 111 and 112 on the lower plate 115, placing the third gear 113 on the spacer 116, placing the upper plate 117 on the third gear 113, covering the upper plate 117 with the cap 118, and tightening with three screws 119. The output axle 114 protrudes beyond the cap 118 (see FIG. 15). As a result, the output gear 102, and the first, the second, and the third gears 111, 112, and 113 are sealed in the cap 118.

As shown in FIGS. 15 through 17, the upper and the lower axles of the first and the second gears 111 and 112 are fitted into and supported by the holes 117*b* and 115*b*, respectively so that the first and the second gears 111 and 112 are sandwiched between the plates 115 and 117. The first gear 111 is meshed with the output gear 102, and the second gear 112 is meshed with the first gear 111. The third gear 113 is meshed with the second gear 112. As a result, the output gear 102 and the first, the second, and the third gears 111, 112, and 113 constitute a reduction gear drive mechanism 110A.

Similar to the pulse motor 100 having the reduction gear drive mechanism head as described above, the pulse motor 120 having the reduction gear drive mechanism head (second motor) includes a pulse motor main body 121 and a reduction gear drive mechanism head 130 integrally mounted on the pulse motor main body 121, and is sealed by a cap 138 of the reduction gear drive mechanism head 130. Namely, the reduction gear drive mechanism head 130 contains a reduction gear drive mechanism 130A including an output gear 122, a first, a second, and a third gears 131, 132, and 133.

As shown in FIGS. 5 through 8, the pulse motor 100 having the reduction gear drive mechanism head is contained inside the frame main body 52 and is fixed to the inner surface of the side plate 55 with screws. The output axle 114 of the pulse motor 100 is protruding outward beyond the side plate 55. The other pulse motor 120 having the reduction gear drive mechanism head is contained inside the frame main body 52 and is fixed to the inner surface of the side plate 56 with screws. The output axle 134 of the pulse motor 120 is protruding outward beyond the side plate 56. The pulse motors 100 and 120 that each have the reduction gear drive mechanism head are substantially symmetrically disposed with respect to the center of the thermal printing apparatus 50.

Therefore, the reduction gears of the reduction gear drive mechanisms are disposed in between the side plates 55 and 56 provided one on each end of the main frame 51 and sealed.

[Structure of the Platen Roller 140]

As shown in FIGS. 4, 9, 11, and 14, the platen roller 140 has two axles provided one on each end of the platen roller 140 and extending outward in both directions. The axles are rotatably mounted on the side plates 55 and 56 provided one on each end of the main frame 51 so that the platen roller 140 is disposed between the side plates 55 and 56.

As shown in FIG. 8, the axle 141X of the platen roller 140 on X1 side is fixed to the pulley 161. On the other hand, the output axle 114 of the pulse motor 100 having the reduction gear drive mechanism head is fixed to the pulley 160. The timing belt is stretched between the pulleys 160 and 161.

As shown in FIG. 7, the length L11 protruding outward beyond the side plate 55 in the X1 direction is about 9 mm which is shorter than the corresponding length about 15 mm of a conventional thermal printing apparatus.

Further, dust may intrude and become attached to the pulleys 160 and 161 and the timing belt 162; however, the dust attached in between the pulley and the timing belt is soft enough to be rubbed into the surface of the timing belt, thereby reducing the wearing of the pulleys. From this point of view as well, the thermal printing apparatus 50 has a longer service life.

It should be noted that a simple cover covering the pulleys 160 and 161 and the timing belt 162 may be provided.

[Structure of the Rotary Blade 150]

As shown in FIGS. 5, 11, and 12, the rotary blade 150 has two axles provide one on each end of the rotary blade 150 and extending outward in both directions. The axles are rotatably mounted on the side plate 55 and 56 provided one on each end of the main frame 51 so that the rotary blade 150 is disposed between the side plates 55 and 56 (see FIG. 11). The rotary blade 150 is disposed on the Y2 side of the thermal printing apparatus 50.

As shown in FIG. 8, the rotary blade 150 has the axle 151 protruding outward beyond the side plate 56. The axle 151 is fixed to a gear 152.

Further, as shown in FIG. 8, the pulse motor 120 having the reduction gear drive mechanism head has its output axle 134. The axle 134 is fixed to the pulley 170 for timing belt.

The platen roller 140 has its axle 141X2 on the X2 side of the platen roller 140. The axle 141X2 protrudes outward beyond the side plate 56 in the vicinity of the gear 152 and is fixed to a gear 155. The gear 155 is an integrated structure of a pulley 171 for timing belt and a gear 157. The gear 157 is meshed with the gear 152. A timing belt 172 is stretched between the pulleys 170 and 171.

The rotation of the pulse motor 120 having the reduction gear drive mechanism head is reduced in one step during the transmission through the pulleys 170 and 171, and the timing belt 172. The rotation is further reduced during the transmission through the gears 157 and 152.

As shown in FIG. 7, the length L12 protruding outward beyond the side plate 56 in the X2 direction is about 9 which is shorter than the corresponding length about 15 mm of a conventional thermal printing apparatus.

Further, dust may intrude and become attached to the pulleys 170 and 171 and the timing belt 172, however, the dust attached in between the pulley and the timing belt is soft enough to be rubbed into the surface of the timing belt, thereby reducing the wearing of the pulleys. From this point of view as well, the thermal printing apparatus 50 has a longer service life.

It should be noted that a simple cover covering the pulleys 170 and 171 and the timing belt 172 may be provided.

[Structure of the Thermal Head 180]

As shown in FIGS. 9 and 12, the thermal head 180 is disposed and fixed under the first subframe 61. Plural portions of the thermal head 180 are biased in the Z2 direction by plural coil springs 181.

[Structure of the Stationary Blade 190]

As shown in FIGS. 9 and 12, both ends of the stationary blade 190 are mounted on the second subframe 62 so that the stationary blade 190 is disposed on the second subframe 62. The stationary blade 190 is biased so that the blade edge of the stationary blade 190 is in contact with the rotary blade 150 due to a torsion coil spring 191.

[Operations of the Thermal Printing Apparatus 50]

The thermal printing apparatus 50 may be embedded in, for example, a portable ticketing system. In the thermal printing apparatus 50, since the reduction gear drive mechanisms are disposed between the both flanges of the frame of the thermal printing apparatus 50, the length L10 in the longitudinal direction of the thermal printing apparatus 50 is shorter than that of a conventional thermal printing apparatus, thereby enabling the reduction of the size of the portable ticketing system (see FIG. 7).

The portable ticketing system including the thermal printing apparatus 50 has a longer service life than a portable ticketing system including a conventional thermal printing apparatus because the reduction gear drive mechanisms are sealed so as to enhance the dust-protecting feature and because the portions where dust may intrude are where there are pulleys and timing belts and the dust having intruded in the portions is soft enough to be rubbed into the surface of the timing belt, thereby reducing the wearing of the pulleys.

To operate the thermal printing apparatus 50, first, the lock member 70 is operated to release the lock to open the subframe assembly 60 (clam-shell) as shown in FIGS. 11 through 14. Then a thermal paper 200 is inserted from the paper insertion opening 210 on the bottom side of the thermal printing apparatus 50 as shown in FIG. 9 and the top of the inserted thermal paper 200 is pulled to the front (Y2 side) of the thermal printing apparatus 50. Then the subframe assembly 60 is pressed downward to close the subframe assembly 60 and is locked by the lock member 70 to its closed condition as shown in FIGS. 9 and 10. As a result, the subframe assembly 60 is joined to the main frame 51, the thermal head 60 is pressed against the platen roller 140 with the thermal sheet 200 interposed in between, and the stationary blade 190 approaches the rotary blade 150 to configure a cutting device 195.

When a printing instruction is issued from a control circuit (not shown), the thermal head 180 is driven to be heated and the pulse motor 100 having the reduction gear drive mechanism head is also driven to rotate the platen roller 140 through the reduction gear drive mechanism 110A in the reduction gear drive mechanism head, the pulley 160, the timing belt 162, and the pulley 161 to print the thermal paper 200. The printed paper portion 201 is fed through the cutting device 195 and is discharged from an exiting opening 211 (see FIG. 9).

When the printing is finished, according to a cutting instruction, the pulse motor 120 having the reduction gear drive mechanism head is driven to rotate the rotary blade 150 for one rotation through the reduction gear drive mechanism 130A in the reduction gear drive mechanism head, the pulley 170, the timing belt 172, the pulley 171, and gears 157 and 152 to cut the paper portion 201 shown in FIG. 9 between the rotary blade 150 and the stationary blade 190.

A belt drive is more quiet than a gear drive. In the thermal printing apparatus 50, the reduction gear drive mechanisms (gear drive) are sealed and belt drives using the timing belts 162 and 172 are provided at the exposed portions. Therefore, advantageously, the thermal printing apparatus 50 is more quiet than a conventional thermal printing apparatus.

It should be noted that the reduction ratio of the thermal printing apparatus 50 can be changed by replacing the pulley 161 fixed to the platen roller 140 with a pulley having a larger diameter and also replacing the timing belt corresponding to the change of the pulley. Therefore, it is possible to change the printing resolution, for example, from 203 dpi to 300 dpi by replacing the pulley and the timing belt.

Further, it should be noted that the thermal printing apparatus 50 may be configured as the thermal printing apparatus 50A described below shown in FIG. 19 so that the subframe assembly 60 can be separated from the main frame 51 and then mounted on the main frame 51.

Embodiment 2

Figure 19:
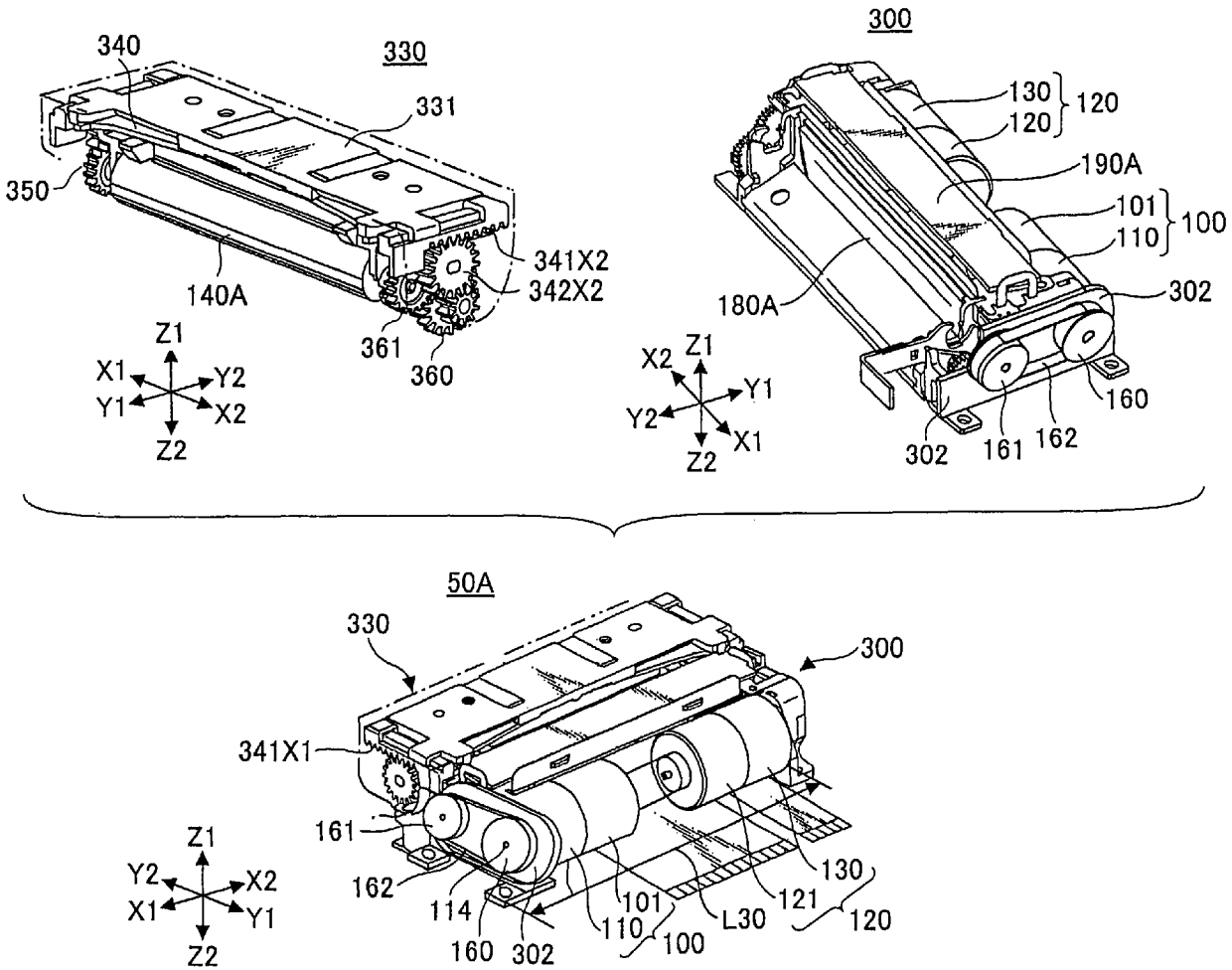
FIG. 19 is a perspective view of a thermal printing apparatus according to a second embodiment of the present invention.
Figure 20:
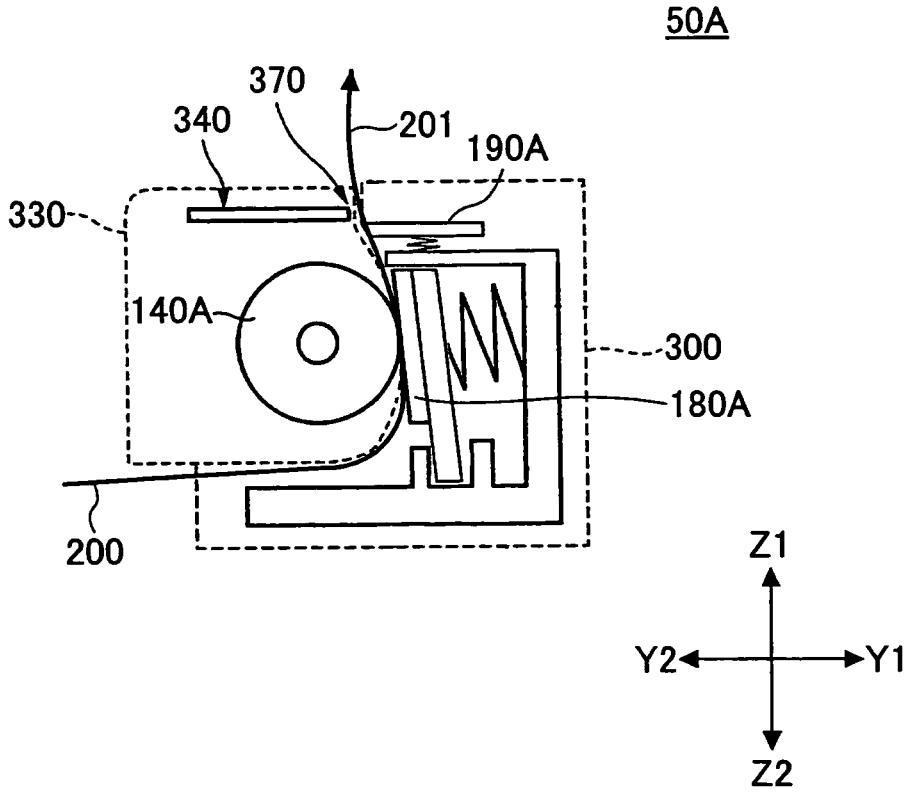
FIG. 20 is a side view schematically showing the thermal printing apparatus in FIG. 19.
Figure 21:
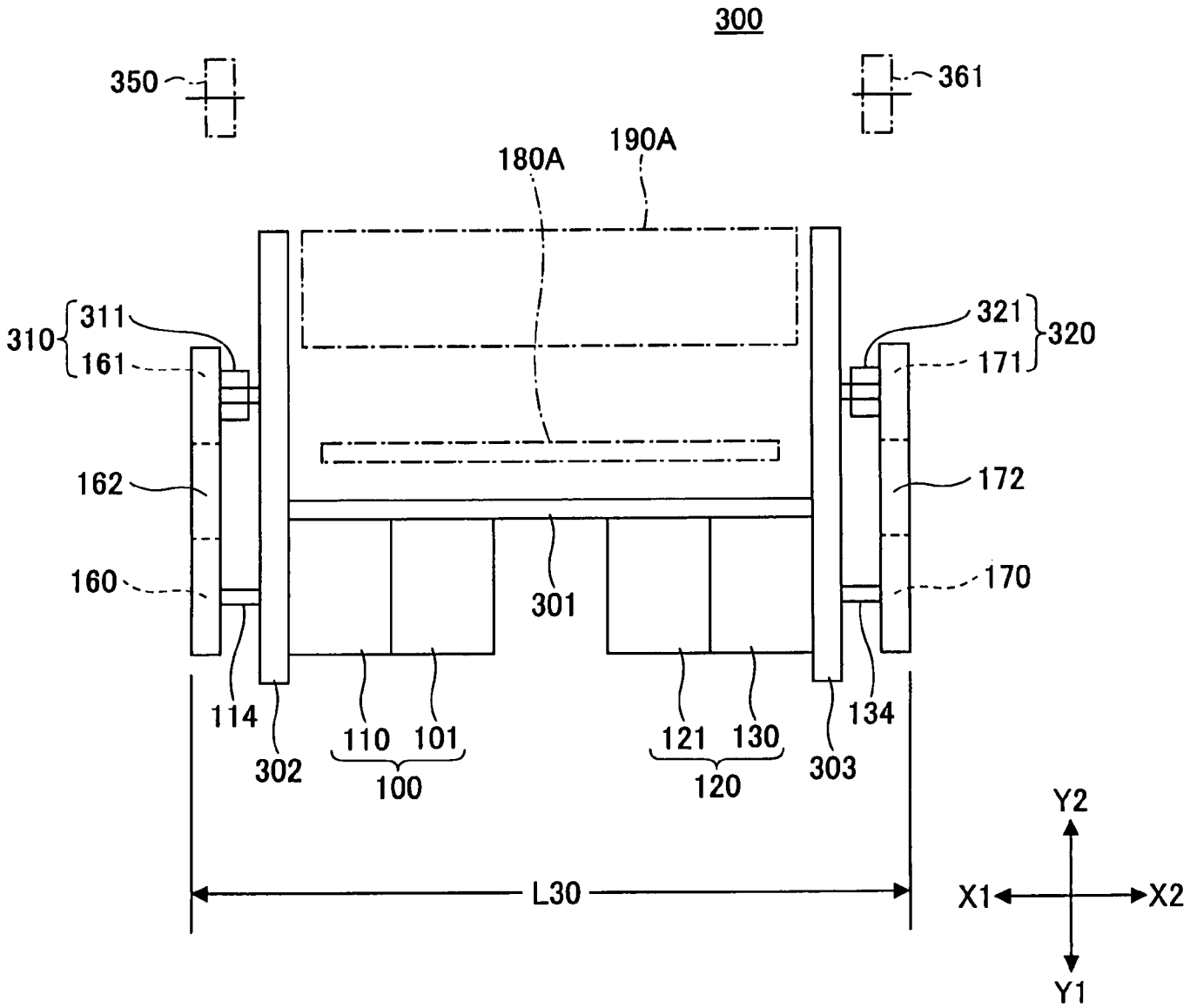
FIG. 21 is a plan view schematically showing a rotation transmission mechanism of the printer main body of the thermal printing apparatus.
Figure 22:
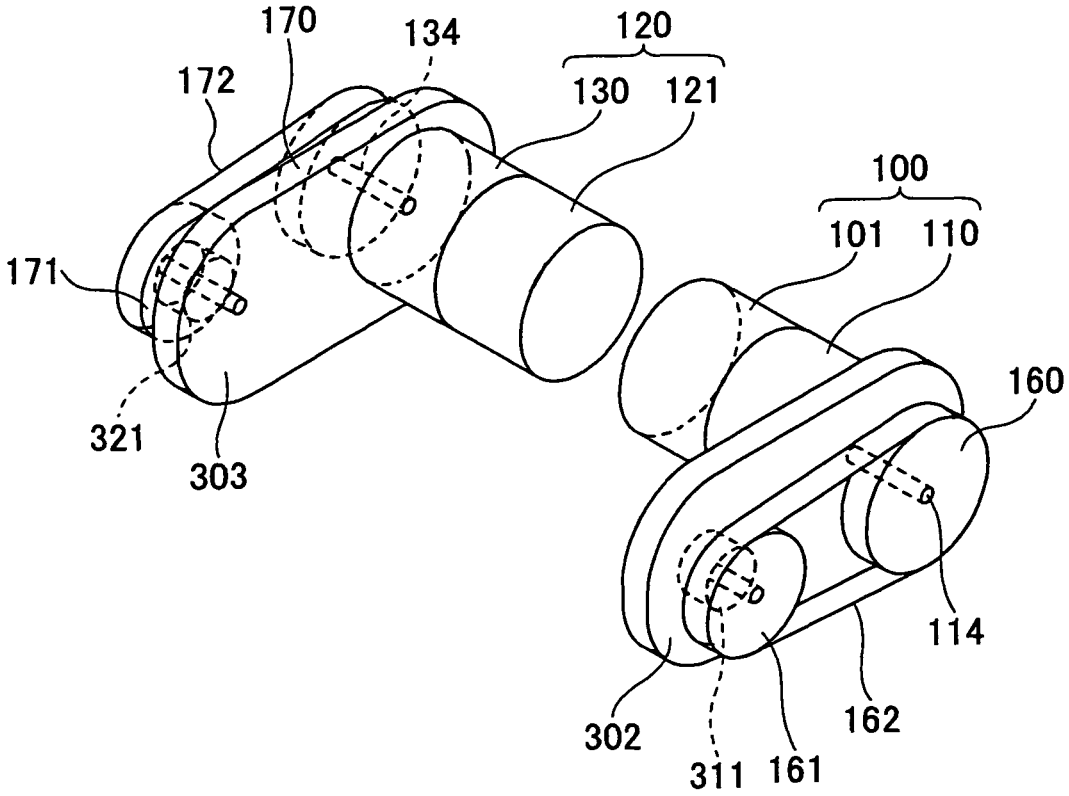
FIG. 22 is a perspective view showing the rotation transmission mechanism in FIG. 21.

FIG. 19 is a perspective view showing a thermal printing apparatus 50A according to a second embodiment of the present invention. FIG. 20 is a side view schematically showing the thermal printing apparatus 50A. FIG. 21 is a top view schematically showing a rotation transmission mechanism of the printer main body 300 of the thermal printing apparatus 50A. FIG. 22 is a perspective view showing the rotation transmission mechanism in FIG. 21.

The thermal printing apparatus 50A includes a printer main body 300 and a module 330 removably mounted on the printer main body 300, having a separatable clam-shell structure. The printer main body 300 includes a thermal head 180A and a stationary blade 190A. The module 330 includes a platen roller 140A and a slidably movable blade 340. Therefore, when the module 330 is separated from the printer main body 300, the thermal head 180A and the stationary blade 190A are separated from the platen roller 140A and the slidably movable blade 340, respectively.

The printer main body 300 further includes the pulse motors 100 and 120 each have the reduction gear drive mechanism head, a main frame 301, and side plates 302 and 303 provided one on each end of the main frame 301. The pulse motors 100 and 120 are provided for driving the platen roller 140A and the slidably movable blade 340, respectively. The pulse motors 100 and 120 are disposed on the rear side (Y1 side) of the main frame 301 and in between the side plates 302 and 303. The thermal head 180A and the stationary blade 190A are fixed to substantially the center of the main frame 301. As shown in FIGS. 21 and 22, the pulse motor 100 having the reduction gear drive mechanism head has an output axle 114. The output axle 114 protrudes outward beyond the side plate 302 and is fixed to the pulley 160. There is another axle protruding outward beyond the side plate 302. The axle is fixed to an intermediate gear 310 that is an integrated structure of a gear 311 and a pulley 161. Further, a timing belt 162 is stretched between the pulleys 160 and 161.

On the other hand, the pulse motor 120 having the reduction gear drive mechanism head has an output axle 134. The output axle 134 protrudes outward beyond the side plate 303 and is fixed to the pulley 170. There is another axle protruding outward beyond the side plate 303. The axle is fixed to an intermediate gear 320 that is an integrated structure of a gear 321 and a pulley 171. Further, a timing belt 172 is stretched between the pulleys 170 and 171.

As shown in FIG. 19, the module 330 includes a subframe 331, the platen roller 140A rotatably mounted on the subframe 331, and the slidably movable blade 340 slidably mounted on the subframe 331.

As shown in FIG. 19, the platen roller 140A has a gear 350 on the one end (X1 side) of the platen roller 140A. Further, there are racks 341X1 and 341X2 fixed one on each side of the slidably movable blade 340. The racks 341X1 and 341X2 are meshed with pinions 342X1 and 342X2, respectively. The pinions 342X1 and 342X2 are fixed to each end of an axle provided across the module 330. The pinion 342X2 is meshed with a two-stage gear 360. The two-stage gear 360 is meshed with the gear 361.

To operate the thermal printing apparatus 50A, first, the module 330 is raised to be separated from the printer main body 300. Then, a thermal paper 200 is positioned so as to be aligned with respect to the platen roller 140A and the stationary blade 190A and then the module 330 is joined to the printer main body 300. As a result, the platen roller 140A is pressed against the thermal head 180A with the thermal paper 200 interposed in between, and the slidably movable blade 340 faces the stationary blade 190A to configure a cutting device 370. Further, the gear 350 is meshed with the gear 311, thereby forming a rotation transmission path from the printer main body 300 to the platen roller 140A. Also, the gear 361 is meshed with the gear 321, thereby forming a rotation transmission path from the printer main body 300 to the slidably movable blade 340.

When a printing instruction is issued from a control circuit (not shown), the thermal head 180A is driven to be heated and the pulse motor 100 having the reduction gear drive mechanism head is also driven to rotate the platen roller 140A through the reduction gears in the reduction gear drive mechanism head, the pulley 160, the timing belt 162, the pulley 161, and gears 311 and 350 to print the thermal paper 200. The printed paper portion 201 is fed through the cutting device 195 and is discharged from the exiting opening of the printing apparatus.

When the printing is finished, according to a cutting instruction, the pulse motor 120 having the reduction gear drive mechanism head is driven to move forward the slidably movable blade 340 in the Y1 direction and then move backward the slidably movable blade 340 in the Y2 direction through the reduction gears in the reduction gear drive mechanism head, the pulley 170, the timing belt 172, the pulley 171, the gears 321, 361, and 360, and racks 341X1 and 341X2 to cut the paper portion 201.

Similar to the thermal printing apparatus 50 according to the first embodiment of the present invention, the longitudinal length L30 of the thermal printing apparatus 50A described above is shorter than that of a conventional thermal printing apparatus. Further, the thermal printing apparatus 50A has a dust-protection feature and a longer service life.

It should be noted that in the thermal printing apparatus 50A, the ends of the module 330 may be rotatably mounted on the printer main body 300 so that the module 330 rotates reciprocally with respect to the printer main body 300 within a prescribed angle range, and when the module 330 rotates so as to be closed, the module 330 is joined to the printer main body 300.

The present invention is not limited to the embodiments described above, and may be applicable to, for example, a thermal printing apparatus having no cutting device, namely, a thermal-printing apparatus including a thermal head, a platen roller, a motor for driving the platen roller, and a mechanism reducing and transmitting the rotation of the motor for driving the platen roller to the platen roller.

The present application is based on and claims the benefit of priority of Japanese Patent Application Nos. 2007-242798, filed on Sep. 19, 2007 and 2007-242799, filed on Sep. 19, 2007, the entire contents of which are hereby incorporated by reference.

What is claimed is:

1. A printing apparatus comprising:

a frame comprising a frame compartment;

a thermal head mounted on the frame and provided to print;

a platen roller mounted on the frame and provided to press a sheet against the thermal head;

a first motor to drive the platen roller;

a first reduction gear drive mechanism provided to reduce and transmit a rotation of the first motor to the platen roller; and a first cap to substantially seat an integrated unit including the first motor and the first reduction gear drive mechanism, wherein an output axle of the first reduction gear drive mechanism is exposed and protrudes through the first cap, wherein the first motor and the first reduction gear mechanism are sealed together within the frame compartment, wherein the entire first reduction gear mechanism is arranged closer to an outer width side of the printing apparatus than the first motor in a horizontal direction, wherein the frame further includes a main frame including the frame compartment and a subframe, the platen roller to feed the sheet and the first motor are mounted on the main frame, the thermal head is in mounted on the subframe, and, when the subframe is joined to the main frame, the thermal head is in contact with the platen roller, wherein the main frame further includes a first side plate defining a side of the frame compartment, wherein the integrated unit including the first motor with the first reduction gear drive mechanism sealed by the first cap is fixed to an inner surface of the first side plate of the main frame, and wherein the output axle protrudes outward beyond the first side plate of the main frame.

2. The printing apparatus according to claim 1, further comprising:

a cutting device mounted on the frame and provided to cut a printed sheet; wherein the first motor is provided to drive the platen roller and the cutting device, and the first reduction gear drive mechanism is provided to reduce and transmit the rotation of the motor to the platen roller and the cutting device.

3. The printing apparatus according to claim 1, further comprising:

a rotary blade;

a second motor to drive the rotary blade;

a stationary blade;

a second reduction gear drive mechanism provided to reduce and transmit the rotation of the second motor to the rotary blade; and a second cap to substantially seal an integrated unit in the second cap, the integrated unit including the second reduction gear drive mechanism and the second motor;

wherein the rotary blade, and the second motor are mounted on the main frame, and the stationary blade is mounted on the subframe, and when the subframe is joined to the main frame, the stationary blade approaches the rotary blade to configure a cutting device.

4. The printing apparatus according to claim 3, wherein the main frame further includes a second side plate, the second side plate being provided on an opposite side of the main frame with respect to the first side plate, and the second motor with the second reduction gear drive mechanism sealed by the second cap is fixed to an inner surface of the second side plate.

5. The printing apparatus according to claim 4, further comprising:

a first pulley provided outside of the first side plate of the main frame and fixed to the output axle of the first reduction gear drive mechanism;

a first timing belt stretched at the first pulley and made of a material softer than that of the first pulley;

a second pulley provided outside of the second side plate of the main frame and fixed to an output axle of the second reduction gear drive mechanism; and a second timing belt stretched at the second pulley and made of a material softer than that of the second pulley.

6. A printing apparatus comprising:

a frame having a side plate which defines a side of a frame compartment;

a thermal head mounted on the frame and provided for print;

a platen roller mounted on the frame and provided to press a sheet against the thermal head;

a first motor mounted on the frame and provided to drive the platen roller; and a first reduction gear drive mechanism provided inside the side plate of the frame and provided to reduce and transmit a rotation of the first motor to the platen roller, wherein the first motor and the first reduction gear drive mechanism are integrally mounted to each other to form a single unit, wherein an output axle of the first reduction gear drive mechanism is exposed and protrudes through the single unit, the first motor and the first reduction gear mechanism being sealed together within the frame compartment by a first cap, and the entire first reduction gear mechanism being arranged closer to an outer width side of the printing apparatus than the first motor in a horizontal direction, wherein the frame further includes a main frame including the frame compartment and a subframe, the platen roller to feed the sheet and the first motor are mounted on the main frame, the thermal head is mounted on the subframe, and, when the subframe is joined to the main frame, the thermal head is in contact with the platen roller, wherein the main frame includes the side plate, wherein the single unit including the first motor with the first reduction gear drive mechanism sealed by the first cap is fixed to an inner surface of the side plate of the main frame, and wherein the output axle protrudes outward beyond the side plate of the main frame.

7. The printing apparatus according to claim 6, further comprising:

a cutting device mounted on the frame and provided to cut a printed sheet;

a second motor mounted on the frame and provided to drive the cutting device; and a second reduction gear drive mechanism provided to reduce and transmit the rotation of the second motor to the cutting device; wherein the frame has two of the side plates provided one on each end of the frame, and the first and the second reduction gear drive mechanisms are provided between the two side plates of the frame.

8. The printing apparatus according to claim 7, wherein the cutting device includes a rotary blade and a stationary blade, the second motor is provided to drive the rotary blade, the rotary blade and the second motor are mounted on the main frame, the stationary blade is mounted on the subframe, the first and the second reduction gear drive mechanisms are provided between the two side plates of the main frame, and when the subframe is joined to the main frame, the stationary blade approaches the rotary blade to configure the cutting device.

9. The printing apparatus according to claim 7, wherein the second reduction gear drive mechanism is disposed inside the other side plate of the main frame with respect to the first reduction drive gear mechanism.

10. The printing apparatus according to claim 9, further comprising a second cap; wherein the second reduction gear drive mechanism is substantially sealed in the second cap.

11. The printing apparatus according to claim 7, wherein the second reduction gear drive mechanism and the second motor are integrally mounted onto each other to form a single unit.

12. The printing apparatus according to claim 11, wherein the second motor with the second reduction gear drive mechanism integrally mounted onto the second motor to form the single unit is fixed to an inside of the other side plate of the frame, to which the first motor and the first reduction gear drive mechanism are not fixed.

13. The printing apparatus according to claim 12, further comprising:

a first pulley;

a first timing belt for the first pulley;

a second pulley; and a second timing belt provided for the second pulley and made of a material softer than that of the second pulley;

wherein the first pulley is fixed to the output axle of the first reduction gear drive mechanism, the first pulley and the first timing belt are disposed outside one of the side plates of the frame, the second pulley is fixed to an output axle of the second reduction gear drive mechanism, and the second pulley and the second timing belt are disposed outside the other side plate of the frame.

14. A printing apparatus comprising:

a frame having a side plate;

a thermal head mounted on the frame and provided to print;

a platen roller mounted on the frame and provided to press a sheet against the thermal head;

a first motor mounted on the frame and provided to drive the platen roller;

a first reduction gear drive mechanism provided inside the side plate of the frame and provided to reduce and transmit the rotation of the first motor to the platen roller, the first reduction gear drive mechanism and the first motor being integrally mounted onto each other to form a single unit, and the first motor with the first reduction gear drive mechanism integrally mounted onto the first motor to form a single unit being fixed to the inside of the side plate of the frame;

a first pulley; and a first timing belt for the first pulley, the first pulley being fixed to an output axle of the first reduction gear drive mechanism, and the first pulley and the first timing belt being disposed outside the side plate of the frame.

* * * * *

UNITED STATES PATENT AND TRADEMARK OFFICE

CERTIFICATE OF CORRECTION

PATENT NO. : 8,550,733 B2
APPLICATION NO. : 12/068127
DATED : October 8, 2013
INVENTOR(S) : Yukihiro Mori et al.

It is certified that error appears in the above-identified patent and that said Letters Patent is hereby corrected as shown below:

In the Claims
In Column 11, Line 28, In Claim 1, delete “seat” and insert -- seal --, therefor.
In Column 11, Line 42, In Claim 1, after “head is” delete “in”.
In Column 12, Line 36, In Claim 6, delete “for” and insert -- to --, therefor.

Signed and Sealed this
Twenty-fourth Day of December, 2013

Margaret A. Focarino

Margaret A. Focarino
*Commissioner for Patents of the United States Patent and Trademark Office*